US007650935B2

(12) United States Patent
Demuth et al.

(10) Patent No.: US 7,650,935 B2
(45) Date of Patent: Jan. 26, 2010

(54) HEAT EXCHANGER, PARTICULARLY FOR A MOTOR VEHICLE

(75) Inventors: Walter Demuth, Gerlingen (DE); Martin Kotsch, Ludwigsburg (DE); Michael Kranich, Besigheim (DE); Hans Joachim Krauss, Stuttgart (DE); Hagen Mittelstrass, Bondorf (DE); Karl-Heinz Staffa, Stuttgart (DE); Christoph Walter, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 524 days.

(21) Appl. No.: 10/499,434

(22) PCT Filed: Dec. 19, 2002

(86) PCT No.: PCT/EP02/14582

§ 371 (c)(1),
(2), (4) Date: Sep. 20, 2004

(87) PCT Pub. No.: WO03/054467

PCT Pub. Date: Jul. 3, 2003

(65) Prior Publication Data

US 2005/0103486 A1 May 19, 2005

(51) Int. Cl.
*F28F 9/04* (2006.01)

(52) U.S. Cl. ..... 165/176; 165/174

(58) Field of Classification Search ..... 165/174, 165/175, 176

See application file for complete search history.

(56) References Cited

U.S. PATENT DOCUMENTS

| | | | | |
|---|---|---|---|---|
| 1,817,948 | A | 8/1931 | Smith | |
| 3,416,600 | A | 12/1968 | Fink | |
| 4,524,823 | A | 6/1985 | Hummel et al. | |
| 5,205,347 | A * | 4/1993 | Hughes | 165/176 |
| 5,242,016 | A | 9/1993 | Voss | |
| 5,295,532 | A * | 3/1994 | Hughes | 165/76 |
| 5,314,013 | A * | 5/1994 | Tanabe | 165/176 |
| 5,318,114 | A * | 6/1994 | Sasaki | 165/176 |
| 5,531,268 | A * | 7/1996 | Hoshino et al. | 165/153 |
| 5,605,191 | A * | 2/1997 | Eto et al. | 165/176 |
| 5,685,366 | A | 11/1997 | Voss et al. | |
| 6,272,881 | B1 | 8/2001 | Kuroyanagi et al. | |
| 6,315,037 | B1 * | 11/2001 | Haussmann | 165/174 |
| 6,546,999 | B1 * | 4/2003 | Dienhart et al. | 165/150 |
| 6,581,679 | B2 | 6/2003 | Fischer et al. | |
| 6,705,386 | B2 | 3/2004 | Demuth et al. | |
| 6,749,015 | B2 | 6/2004 | Moreau | |
| 6,827,139 | B2 * | 12/2004 | Kawakubo et al. | 165/173 |
| 7,066,243 | B2 * | 6/2006 | Horiuchi et al. | 165/176 |
| 2002/0134538 | A1 | 9/2002 | Moreau | |
| 2005/0039901 | A1 | 2/2005 | Demuth et al. | |

FOREIGN PATENT DOCUMENTS

| | | |
|---|---|---|
| DE | 31 36 374 A1 | 3/1983 |
| DE | 33 11 579 A1 | 10/1984 |
| DE | 38 13 339 A1 | 11/1989 |

(Continued)

*Primary Examiner*—Allen J Flanigan
(74) *Attorney, Agent, or Firm*—Foley & Lardner LLP

(57) ABSTRACT

The invention relates to a heat exchanger comprising tubes (2, 3) that can be flown through along a number of hydraulically parallel flow paths (2*c*, 2*d*) that are comprised of sections.

31 Claims, 27 Drawing Sheets

FOREIGN PATENT DOCUMENTS

| | | | |
|---|---|---|---|
| DE | 195 15 526 | C1 | 5/1996 |
| DE | 197 19 256 | A1 | 11/1998 |
| DE | 197 19 261 | A1 | 11/1998 |
| DE | 198 26 881 | B4 | 12/1999 |
| DE | 100 200 763 | A1 | 11/2000 |
| DE | 100 49 256 | A1 | 4/2002 |
| DE | 100 56 074 | A1 | 5/2002 |
| DE | 101 23 247 | B4 | 11/2002 |
| EP | 0 563 471 | A1 | 10/1993 |
| EP | 0 634 615 | A1 | 1/1995 |
| EP | 0 849 557 | A1 | 6/1998 |
| EP | 845 648 | A2 | 6/1998 |
| EP | 1 070 929 | A2 | 1/2001 |
| EP | 1 167 911 | A2 | 1/2002 |
| EP | 1 195 569 | A1 | 4/2002 |
| EP | 1 221 580 | A2 | 7/2002 |
| FR | 2 803 378 | A1 | 7/2001 |
| JP | 62-131195 | A | 6/1987 |
| JP | 62-153685 | A | 7/1987 |
| JP | 63-134267 | | 9/1988 |
| JP | 03-87169 | | 9/1991 |
| JP | 4-68297 | A | 3/1992 |
| JP | 4-80593 | A | 3/1992 |
| JP | 5-346297 | A | 12/1993 |
| JP | 9-189498 | A | 7/1997 |
| JP | 2002-081795 | A | 3/2002 |
| WO | WO 99/23432 | A1 | 5/1999 |
| WO | WO 01/06193 | A1 | 1/2001 |
| WO | WO 0150080 | A2 * | 7/2001 |
| WO | WO 01/88445 | A1 | 11/2001 |
| WO | WO 03/054465 | A1 | 7/2003 |
| WO | WO 03/054466 | A1 | 7/2003 |

* cited by examiner

HEAT EXCHANGER, PARTICULARLY FOR A MOTOR VEHICLE

The invention relates to a heat exchanger with tubes which, along a plurality of hydraulically parallel flow paths, can have a first medium flowing through them and a second medium flowing around them.

A heat exchanger of this type is described, for example, in EP 0 563 471 A1. The heat exchanger disclosed by that document is designed as a two-row flat-tube evaporator which has two flows of medium passing through it. Corrugated fins which have ambient air flowing over them are located between the flat tubes. The refrigerant first of all flows through the rear row of flat tubes, as seen in the main direction of flow of the air, from the top downward and is then collected and diverted, by means of a diverter device, in the opposite direction to the direction of flow of the air, entering the first, i.e. front row of flat tubes, through which it flows from the bottom upward. With this design, therefore, the refrigerant is diverted over the depth, i.e. counter to the direction of flow of the air. As a result, the flow paths for the refrigerant in each case comprise two sections, with each section corresponding to a tube length. The refrigerant is distributed and collected by a collection and distribution device, which is formed by a multiplicity of plates which are layered on top of one another and are soldered together. These plates substantially, comprise a base plate, a distributor plate above it, with a partition running in the longitudinal direction, and a cover plate with feed and discharge openings for the refrigerant. In a similar way, the diverter device arranged on the opposite side is composed of individual plates. This results in a low overall height of this evaporator. In addition, there is optionally what is known as a stop plate, which is in each case laid onto the base plate and forms a stop for the tube ends. One drawback of this type of evaporator is that the refrigerant, on account of the distribution or collection chamber extending over the entire width of the evaporator, is distributed unevenly to the individual tubes. Furthermore, the two-row design requires increased assembly outlay.

What is known as a divider plate with individual openings for distributing the refrigerant between the individual tubes has been proposed for a similar evaporator in EP 0 634 615 A1. This results in more uniform distribution of the refrigerant to the tubes, but this is at the expense of an increased number of plates and therefore higher outlay on materials and assembly.

U.S. Pat. No. 5,242,016 describes an evaporator with refrigerant distribution through passages in a large number of plates, which likewise contribute to a more uniform distribution of the refrigerant between heat-exchanger tubes. However, this requires a very large number of plates and high manufacturing costs.

DE 100 20 763 A1 has disclosed a further design of evaporator, which is intended for operation with $CO_2$ as refrigerant and in which a pressure-resistant collector housing is to be achieved by virtue of the fact that a multiplicity of plates provided with apertures are stacked on top of one another and soldered together. This evaporator is of one-row design, specifically with multi-chamber flat tubes through which medium flows both upward and downward, which is made possible by a diverter device located at the lower end of the tubes. One drawback of this design of evaporator is the large number of plates with relatively narrow passages, which firstly entails additional weight and secondly involves the risk of the passages in the collector housing being closed up during soldering, i.e. becoming blocked by solder.

EP 1 221 580 A2 has described an evaporator for a fuel cell system, which comprises a header piece which includes a base plate and a cover plate secured to it. Fuel passes via a connection part into a fuel distributor chamber, and from there into guide passages and via apertures in the base plate into heat-uptake passages of the evaporator. In this fuel evaporator, there is a small number of plates in the header piece, but these plates are highly complex to manufacture. Moreover, supply of fuel to the heat-uptake passages is very uneven depending on the pressure distribution in the fuel distributor chamber and in the guide passages.

WO 01/06193 A1 shows a serpentine heat exchanger with an inlet header piece, a serpentine tube and an outlet header piece. On account of the long distance which a medium flowing through the tube has to cover inside the heat exchanger, a heat exchanger of this type involves an undesirably high pressure drop for this medium. The tube bends, the overall length of which, on account of the fact that the inlet header piece and the outlet header piece are arranged on different sides of the heat exchanger, is at least equal to a width of the heat exchanger, do not adjoin the fins and therefore make scarcely any contribution to heat transfer. As a result, the pressure loss is unnecessarily increased to an additional extent.

The object of the invention is to provide a heat exchanger and/or an air-conditioning device in which it is possible to realize a plurality of hydraulically parallel flow paths with a simple design and/or a uniform distribution of a medium to the flow paths.

This object is achieved by a heat exchanger having the features of claim 1 and by an air-conditioning device having the features of claim 24.

According to claim 1, a heat exchanger has tubes which, along a plurality of hydraulically parallel flow paths, can have a first medium flowing through them and a second medium flowing around them. The object of the invention is advantageously achieved by virtue of the fact that two sections of a flow path, through which medium can flow in opposite directions, are arranged next to one another in the main direction of flow of the second medium.

The basic concept of the invention is for a plurality of hydraulically parallel flow paths each themselves to be constructed in serpentine form from a plurality of sections. Arranging the flow-path sections, through which medium can flow in particular in succession, next to one another means that the number of mutually parallel flow paths is reduced for a predetermined surface area of the heat exchanger onto which the second medium can flow. This firstly facilitates more uniform application of medium to the flow paths of the heat exchanger, and secondly if each flow path comprises an even number of serpentine sections, allows what is known as a single-tank construction, in which all the distribution and/or collection devices which may be present are arranged on the same side of the heat exchanger and in particular form a structural unit.

To avoid an excessive loss of pressure in the first medium along the heat exchanger, the number of parallel flow paths should not be selected to be too small, since otherwise the paths, on account of their length, may under certain circumstances form an excessive flow resistance for the first medium.

According to a preferred configuration of the invention, the flow paths which are parallel to one another are likewise arranged next to one another in the main direction of flow of the second medium. It is particularly preferable for the flow paths not to overlap in this arrangement, when seen in the main direction of flow of the second medium. This ensures uniform application of the second medium to the paths, with the result that the heat transfer from the first medium to the second medium or vice versa becomes even more uniform and therefore more effective, i.e. the performance of the heat exchanger is improved.

According to an advantageous embodiment, the heat exchanger has an end face which the flow of second medium can reach and which can be divided into a plurality of continuous sub-surfaces, with the parallel flow paths each being assigned to one of these continuous subregions. This brings with it the advantage that, under certain circumstances, only a very small proportion of the flow paths is arranged outside a heat-transfer region, and therefore unnecessary pressure loss is reduced.

By way of example, a rectangular end face of the heat exchanger can be divided into adjacent, likewise rectangular strips, in which case the flow paths are, as it were, arranged stacked on top of one another. A modular structure of this type allows standardization, with the aid of which it is possible to produce heat exchangers for different applications, capacity demands or dimensions by assembling them from simple modules, which are in this case provided by the flow paths.

According to one preferred embodiment, a heat exchanger includes tubes through which a first medium can flow and around which a second medium can flow, so that heat can be transferred from the first medium to the second or vice versa through walls of the tubes. For this purpose, heat-exchange passages, through which the first medium can be passed, are located in the tubes, with an individual tube having either one heat-exchange passage or, as what is known as a multi-chamber tube, having a plurality of heat-exchange passages located next to one another. The tubes may in this case have a circular, oval, substantially rectangular or any other desired cross section. By way of example, the tubes are designed as flat tubes. To increase the heat transfer, it is if appropriate possible to arrange fins, in particular corrugated fins, between the tubes, in which case the tubes and the fins can in particular be soldered to one another.

There are various conceivable uses for the heat exchanger, for example as an evaporator of a refrigerant circuit, in particular of a motor vehicle air-conditioning system. In this case, the first medium is a refrigerant, for example R134a or R744, and the second medium is air, with heat being transferred from the air to the refrigerant. However, the heat exchanger is also suitable for other media, in which case the heat can if appropriate also be transferred from the first medium to the second.

If appropriate, there are at least two collection chambers, it being possible for the first medium to be passed from a first collection chamber to a second collection chamber. In the context of the invention, the term flow-path section is to be understood as meaning one or more heat-exchange passages which run from one side of the heat exchanger to an opposite side and are hydraulically connected in parallel with one another. The heat-exchange passages of a flow-path section are, for example, arranged in a single tube, although an arrangement of the heat-exchange passages of a flow-path section which is distributed between a plurality of tubes is also conceivable.

According to an advantageous embodiment, the heat exchanger has a distribution and/or collection device with a tube plate which actually comprises a number of plates bearing against one another, namely a base plate, a diverter plate and a cover plate. The base plate can be connected to ends of the tubes by virtue of the base plate having, for example, cutouts, in which the tube ends can be received. Within the context of the invention, it is also conceivable to use other types of connection between tubes and the base plate, for example connections produced by extensions at the edges of cutouts in the base plate, so that the tubes can be plug-fitted onto the extensions. Cutouts in the diverter plate serve to form through-passages and/or diverter passages, which can be closed off in a fluid-tight manner with respect to an environment surrounding the heat exchanger by means of a cover plate. The plate structure of the tube plate allows the distribution and/or collection device and the entire heat exchanger to be of very pressure-stable construction.

According to one preferred embodiment, a collection box which may if appropriate be integrated into the distribution and/or collection device is soldered or welded to the cover plate in a fluid-tight manner. According to another advantageous embodiment, the collection box is formed integrally with the cover plate, thereby simplifying production. A particularly lightweight construction is achieved by designing the collection box in the form of a tube in accordance with a further configuration of the invention. It is particularly preferable for the cover plate, at edges of apertures, to have extensions which engage into apertures in a housing of the collection box. Conversely, according to another embodiment it is possible to provide apertures in the collection-box housing with extensions which engage in apertures in the cover plate. In both cases, manufacturing reliability is increased by aligning the apertures which are to be flush with one another in the cover plate and in the collection-box housing.

According to a preferred embodiment, the passage openings which are formed by the flush apertures in the cover plate and in the collection-box housing have different cross sections of flow. This makes it easy to adapt the distribution of the first medium to the flow conditions in the associated collection chamber. In particular, a uniform distribution between a plurality of flow paths is desirable in this context, although a deliberately uneven distribution is conceivable, for example, in the case of a non-uniform mass flow of the second medium over an end face of the heat exchanger.

It is advantageous for the passage openings with different cross sections of flow to be arranged upstream of the heat-exchange passages, so that it is particularly easy to balance out the flow in the flow paths. If through-flow quantities through the flow paths are controlled on an inlet side for the first medium, the passage openings on the outlet side can be made larger, for example with a cross section of flow which corresponds to the cross section of flow of the corresponding flow path. If the heat exchanger is used, for example, as an evaporator in a refrigerant circuit, the pressure ratios along the circuit are more advantageous for the performance of the heat exchanger if cross sections of flow are narrowed prior to heating of the refrigerant than if the cross sections of flow are narrowed after this heating.

According to one configuration, the cross sections of flow of the passage openings can be adapted to a pressure distribution of the first medium within the corresponding collection chamber. In another configuration, the cross sections of flow can be adapted to a density distribution of the first medium within the collection chamber in question. In the context of the invention, the term density of a medium is, in the case of single-phase media, to be understood as meaning the physical density, whereas, in the case of multiphase media, for example in the case of media which are partially in liquid form and partially in gas form, it is to be understood as meaning a mean density across the volume in question.

In one preferred embodiment, and for similar reasons, the cross-sectional areas of the first and second collection chambers are different from one another. It is particularly preferable for it to be possible to match the cross-sectional areas of the collection chambers to the density ratios of the first medium in the chambers.

According to one preferred embodiment, the distribution and/or collection device comprises a housing and at least one collection chamber. It is particularly preferable for the distribution and/or collection device also to comprise a tube plate with cutouts into which the tubes can be received.

According to a further configuration, the heat exchanger has at least one refrigerant inlet and at least one refrigerant outlet, which according to a preferred embodiment open out in at least one header tube. According to a preferred embodiment, the header tube itself is divided into at least one inlet section and at least one outlet section by at least one separating element, these sections preferably respectively being assigned to a refrigerant inlet and a refrigerant outlet. The inlet and outlet sections, which are separated from one another in a liquid-tight and/or gastight manner by at least one separating element, of the header tube are fluid-connected by means of a plurality of flow-path sections and preferably at least one transverse distributor.

According to a particularly preferred embodiment, the refrigerant inlets or refrigerant outlets are tubes with a defined cross section, in the periphery of which there are bores which are arranged substantially perpendicular to the longitudinal center axis of the refrigerant inlet tube or refrigerant outlet tube and which, according to a particularly preferred embodiment, on their center line intercept the longitudinal center axis of the refrigerant inlet tubes or refrigerant outlet tubes or are arranged at a predetermined distance therefrom. According to a particularly preferred embodiment, the center line of the bore is offset with respect to the longitudinal center axis of the header tube, so as to form a tangent on the outer periphery of the refrigerant inlet tube or refrigerant outlet tube.

According to a refinement, the refrigerant inlets or refrigerant outlets of a plurality of interconnected assemblies are of single-piece design.

According to one preferred embodiment of the present invention, the separating element which divides the header tube into an inlet section and an outlet section is connected to the header tube in such a way that the exchange of gaseous or liquid media between the sections is prevented.

According to a preferred embodiment, the header tube has a substantially cylindrical basic shape, with a predetermined number of leadthroughs arranged in its circumference, through which the refrigerant inlets and refrigerant outlets and at least one tube, in particular a flat tube, extend into the interior of the header tube. According to a particularly preferred embodiment, the leadthroughs for the flat tubes to pass into the interior of the header tube are configured in such a manner that the flat tubes are not only connected to the header tube by means of a cohesive bond, but also, as a result of additional pressing of the header tube, a flat tube or flat tubes which has/have been introduced is/are connected nonpositively to the walls of the header tube. According to a particularly preferred embodiment, a header tube for this joining method has a basically Ω-shaped cross section, in the narrowest region of which the leadthroughs for the through-flow devices, in particular for a flat tube, are provided. According to a further embodiment, it is even possible for a plurality of flat tubes to be received in one or more leadthroughs.

According to a particularly preferred embodiment, the leadthroughs have an outer contour which corresponds to that of the object which is to pass through them, in particular that of the refrigerant inlet or refrigerant outlet tube and that of the flat tube, or are at a predetermined distance from one another. Furthermore, the apertures, with respect to their center line, are arranged offset by a predetermined distance from the center line of the header tube or of the transverse distributor.

According to one advantageous configuration, the header tube has, at an edge of at least one leadthrough, an extension which engages into a leadthrough of the refrigerant inlet or outlet. As a result, the header tube is fixed with respect to the refrigerant inlet or outlet during assembly of the apparatus, which facilitates manufacture of the apparatus for exchanging heat.

According to a further particularly preferred embodiment of the heat exchanger, a tube, in the region of the leadthroughs which project into the header tube, has at least one recess into which, for example, the separating element which divides the header tube into an inlet section and an outlet section engages. In a further embodiment, the heat exchanger has a separating element with a recess into which a tube, in particular a flat tube, engages into the header tube in the region of the leadthrough. This arrangement ensures that the regions of the inlet section and of the outlet section are sealed in a liquid-tight and gastight manner with respect to one another in the header tube, and defined positioning and fixing of the tubes is ensured.

According to a further embodiment, the header tubes and/or the refrigerant inlet and/or outlet are configured in such a way that the pressure of the first medium across the inlet and outlet sections is substantially equal or adopts a predetermined value. For the refrigerant inlet, this may preferably, under certain circumstances, be achieved by virtue of the cross section of flow of the refrigerant inlet tapering over the number of header tubes fluid-connected to it, so that the pressure drop at each "removal point" is as far as possible compensated for. In this case, the refrigerant outlet particularly preferably has the largest possible cross section of flow.

Alternative embodiments are also within the scope of the present invention, in which context the configuration of the opening or of the refrigerant leadthrough of the header tube and/or its size can likewise be used to even out the pressure or density level of the header tubes arranged at the refrigerant inlet.

According to one particularly preferred embodiment, it is also possible for the various removal points from the refrigerant inlet or outlet to be divided into flow regions by using a pushed-in profiled section which is cohesively joined to the surrounding tube. By way of example, the tube is divided into 2, 3 or 4 or further flow regions. Predetermined rotation of the profile section in the tube connects the flow regions of the refrigerant inlet or refrigerant outlet to the corresponding removal regions, for example the bore which opens out into the header tube.

According to a further preferred embodiment, the volumes of the inlet and outlet sections of a header tube have a predetermined ratio to one another, and this ratio may in particular be 1:1, 1:2, 1:4, 1:10 and any desired values in between. This in particular takes account of the changing density of the coolant during evaporation or cooling. If the heat exchanger is used as an evaporator, this arrangement makes it possible, for example, to take into account the fact that the volume of the refrigerant increases significantly as a result of its evaporation, and therefore a larger cross section of flow is required to transport the refrigerant mass flow. For example, the density ratio for $CO_2$ between refrigerant inlet and refrigerant outlet is between 1:2 and 1:10, preferably between 1:3 and 1:7, and is particularly preferably approx. 1:5.

According to a preferred embodiment, the openings in the tubes open out into an interior space of a header tube or of a transverse distributor. Furthermore, the components are connected to one another cohesively, nonpositively and/or positively, in such a way that the interior of the components is gastight and/or liquid-tight with respect to the surrounding environment of the heat exchanger even in particular at high pressures of up to approx. 300 bar.

According to a further preferred embodiment, at least one transverse distributor has a second separating element, which divides the transverse distributor into at least two flow sections. Furthermore, a heat exchanger according to a preferred embodiment has at least one tube which extends into the interior of a transverse distributor.

According to a further preferred embodiment, the heat exchanger has, as a further component, cooling fins which in particular are connected to a region of the outer surface of the tubes in such a way that the transfer of thermal energy is promoted. According to one particularly preferred embodiment, the cooling fins are cohesively joined to the surface of the tubes, with soldering processes, welding processes and adhesive-bonding processes in particular being used to produce the cohesive bond. It is preferable for the cooling fins to be joined to the surfaces of the tubes in such a manner that the cohesive bond is effected in particular at the turning points of the cooling fins. According to a particularly preferred embodiment, the cooling fins have a serpentine-like basic structure in the direction of flow, the depth of which structure substantially corresponds to the overall depth of the assembly or the width of the tubes.

Furthermore, the cooling fins include slots which extend substantially between the two connecting points or turning points of the cooling fins. According to a particularly preferred embodiment, these slots in the cooling fins are between 1 and 15 mm long, preferably between 2 and 13 mm long and particularly preferably between 3.7 and 11.7 mm long. Furthermore, the width of these slots is between 0.1 and 0.6 mm, preferably between 0.1 and 0.5 mm and particularly preferably between 0.2 and 0.3 mm. These so-called "gills" of the coolant fins allow improved heat transfer between the gas flowing through and the cooling fins or walls of the tubes. Furthermore, the cooling fins are characterized by a wall thickness which is between 0.01 and 0.5 mm, preferably between 0.02 and 0.07 mm and particularly preferably between 0.07 and 0.15 mm. The fin density of the cooling fins is 10 to 150 fins per dm, preferably 25 to 100 fins per dm and particularly preferably 50 to 80 fins per dm. In a particularly preferred embodiment, the fin height is 1 to 20 mm, preferably 2 to 15 mm and particularly preferably 3 to 12 mm.

In one preferred embodiment, the heat exchanger uses a refrigerant which includes at least one component selected from a group consisting of gases, in particular carbon dioxide, nitrogen, oxygen, air, ammonia, hydrocarbons, in particular methane, propane, n-butane, and liquids, in particular water, floe ice, brine, etc. According to a particularly preferred embodiment, the refrigerant used is carbon dioxide, the physical properties of which can be used as a colorless, incombustible gas in order to increase the refrigeration capacity, possibly reduce the size of the unit and/or to reduce losses of capacity.

According to one preferred embodiment, the heat exchanger, but at least the tubes and in particular the cooling fins, has/have a preferably gaseous medium, in particular air, flowing around it/them.

According to a particularly preferred embodiment, the heat transfer between the first medium and the second medium is substantially effected by convection and heat conduction. For example, the air flowing around the heat exchanger releases thermal energy to the cooling fins, from which the heat can be transferred to the refrigerant via the cooling fins and the walls of the tubes. For heat conduction, the components are connected to one another in such a way that the transfer of thermal energy is promoted. This is effected in particular by cohesive, nonpositive and positive connection, such as for example by soldering, welding, flanging or adhesive bonding.

Furthermore, the transition regions of the components of the heat exchanger through which fluids flow are connected to one another in a gastight and liquid-tight manner, so that exchange of the first medium with the second medium is prevented. In particular if low-molecular-weight refrigerant, such as for example carbon dioxide, is used, it is particularly important to achieve a connection between the components which prevents the refrigerant or its components from escaping.

In one preferred embodiment, the heat exchanger has frame elements at two opposite sides, these frame elements extending at least over part of the side face of the heat exchanger. These frame elements are preferably profiled-section elements which, inter alia, may have a U-shaped, V-shaped, L-shaped or other typical profiled-section structure. Furthermore, these frame elements are nonpositively and/or positively connected to at least one component of the heat exchanger. Cohesive joining, such as for example by soldering, welding and adhesive bonding, is also within the scope of the present invention.

Furthermore, it should be noted that the substantially cylindrical header tubes, refrigerant inlets and refrigerant outlets and the transverse distributor, as well as an exactly cylindrical or tubular configuration, may also take different shapes, such as for example deformed cylindrical or elliptical, polygonal or rectangular cross sections.

According to one preferred embodiment, the refrigerant inlets or outlets, the header tube and the transverse distributor are arranged on one side of the heat exchanger. In this case, the heat exchanger has in particular a cuboidal basic shape, which preferably has a front surface and a rear surface, which according to one particular embodiment represents the sides of the heat exchanger through which substantially the gaseous medium, for example air flows in order to release or take up energy, in particular thermal energy.

The front and rear surfaces of the assembly are delimited by four side faces which are substantially defined by a width or diameter of the heat-exchange tubes used and the adjoining cooling fins, as well as the shape thereof. However, it is also possible to select alternative embodiments of this preferred rectangular basic shape, which correspond in particular to the requirements relating to arrangement in an air-conditioning installation or a ventilation device.

Further embodiments of the heat exchanger according to the invention relate to the connection of the flow-path sections by means of diverter passages, which may be arranged in particular in a diverter plate or in transverse distributors.

According to one advantageous configuration, flow-path sections which are arranged next to one another in the main direction of flow of the second medium are connected to one another by a diverter passage. This is then referred to as a diversion over the width. This makes it possible for a plurality of flow-path sections within a row or within a tube row to be connected to one another to form a flow path. This leads to a local serpentine design of the heat exchanger. In another configuration, the interconnected flow-path sections are arranged one behind the other in the main direction of flow of the second medium. This is then known as a diversion over the depth. This makes it possible for flow paths for the first medium to be connected in parallel or antiparallel with the main direction of flow of the second medium. This leads to a local countercurrent design of the heat exchanger.

According to a further embodiment, two flow-path sections within a tube are connected to one another by a diverter passage. This means that the first medium flows through the tube in one direction and flows back through the same tube but in different heat-exchange passages in the opposite direction. The use of tubes with a large number of heat-exchange passages therefore reduces the total number of tubes and therefore the manufacturing costs.

According to one preferred configuration, the number of sections of at least one flow path can be divided by two. This means that it is easy to connect up a two-row arrangement of the flow-path sections, by virtue of the first half of the sections of a flow path being arranged in a first row and being connected to one another by diversions over the width, whereas the second half of the sections are arranged in a second row and are likewise connected to one another by diversions over the width, with the two halves of the flow path being connected by a diversion over the depth. This diversion over the depth takes place, for example, in a diverter passage on the opposite side of the heat exchanger from the collection chambers. It is particularly preferable for the number of sections of the flow path to be divisible by four. This means that with a two-row arrangement of the flow-path sections connected up as described above, the diversion over the depth takes place on that side of the heat exchanger on which the collection chambers are located as well. As a result, if appropriate it may be possible to configure just one diverter plate of the heat exchanger if the heat exchanger is designed for predetermined requirements, whereas other components are left unchanged.

In one configuration, the first and last flow-path sections within one or more tube rows are not acted on as hydraulically the first sections of flow paths, since the flow and/or pressure conditions of the first medium are unfavorable for application to flow paths in the edge region of collection chambers, which are usually arranged along tube rows.

According to an advantageous embodiment, two adjacent flow paths run mirror-symmetrically with respect to one another. It is particularly preferable for diverter passages of at least two flow paths to communicate. This results in additional compensation of the through-flow within the flow paths. With a mirror-symmetrical profile of the flow paths communicating with one another, communication between the then optionally adjacent diverter passages is particularly simple to realize, for example by omitting a web which may under certain circumstances otherwise be present between two diverter passages.

In a further preferred embodiment, a cross section of flow of a flow path changes over the course of its profile. This is very simple to realize, for example by flow-path sections with a small number of heat-exchange passages being connected, via correspondingly configured diverter passages, to flow-path sections with a large number of heat-exchange passages. It is particularly preferable to match the cross section of flow of one flow path to a density of the first medium which changes along the flow path.

According to one advantageous embodiment of the invention, a simplified structure is also made possible by tubes which have been deformed in a U-shape, with the tubes being deformed once or, to provide a structure which may under certain circumstances be even simpler, a number of times. As a result, two tube-plate connections and possibly one diverter passage are eliminated in the region of the U-shaped deformation. If exclusively U-tubes are used, it is even possible to eliminate an end piece, if all the diversions on one side of the heat exchanger are realized by deformations of tubes. In this case, the ends of in each case one tube can under certain circumstances be connected to the same base plate or the same tube plate.

According to a preferred embodiment, all the tubes have precisely one tube bend. This results in a modular construction with a large number of structurally identical parts.

In the case of a flat tube, a tube bend is particularly preferably curved in the direction of a short side of the flat tube, since as a result reduced stresses occur in the tube material during the deformation.

According to a particularly preferred embodiment, the tubes each have between 1 and 10 tube bends, with the diverter passages being arranged, if appropriate, on the same side or on opposite sides of the heat exchanger depending on whether the number of tube bends is odd or even, as a distribution and/or collection device. For example, if there are 2, 4, 6, 8 or 10 tube bends, the diverter passages are arranged on the opposite side from the distribution and/or collection device. If there are 1, 3, 5, 7 or 9 tube bends, the diverter passages and the distribution and/or collection device are, by contrast, arranged on the same side of the heat exchanger.

According to one preferred embodiment, the sections of a flow path are of substantially equal length. According to a particularly preferred embodiment of the present invention, there is provision for the length of a flow-path section between two tube bends to possibly differ from the length of other sections of the same or other flow paths.

Furthermore, a tube designed as a flat tube is characterized, in cross section, by a width of between 10 mm and 200 mm, preferably between 30 mm and 70 mm, and by a height of between 1.0 mm and 3 mm, preferably between 1.4 mm and 2.4 mm, and an outer wall thickness of between 0.2 mm and 0.8 mm, preferably between 0.35 mm and 0.5 mm. Furthermore, heat-exchange passages in the interior of the tubes are circular or elliptical in cross section, but in particular in the edge region of the flat tube are matched to the outer contours of the flat tube in such a way that the thickness is never less than a minimum wall thickness.

According to one particularly preferred embodiment, the components, such as for example the flat tubes, are produced at least from a material which is selected from the group of materials consisting of metals, in particular aluminum, manganese, magnesium, silicon, iron, brass, copper, tin, zinc, titanium, chromium, molybdenum, vanadium and alloys thereof, in particular wrought aluminum alloys with a silicon content of from 0 to 0.7% and a magnesium content of between 0.0-1%, preferably between 0.0-0.5%, and particularly preferably between 0.1 and 0.4%, preferably EN-AW 3003, EN-AW 3102, EN-AW 6060 and EN-AW 1110, plastics, fiber-reinforced plastics, composite materials, etc.

In a further embodiment, the heat exchanger comprises flat tubes which have a refrigerant in liquid and/or vapor form flowing through them, corrugated fins arranged between the flat tubes and acted on by ambient air, a collection and distribution device for supplying and discharging the refrigerant, the collection and distribution device comprising a plurality of interrupted plates which are layered on top of one another, so as to form refrigerant passages, with the ends of the flat tubes being held in receiving openings in a base plate, and a diverter device for diverting the refrigerant in the direction of flow of the ambient air, the heat exchanger comprising a series of flat tubes, with in each case one flat tube having two flow sections running parallel, through which medium flows in succession, these flow sections being connected by the diverter device, each flat tube, at the end side, having a groove between the two flow sections in the center of the flat-tube end, and the base plate, between the receiving openings, having webs, the dimensions of which, in terms of height and width, corresponding to the grooves, so as in each case to form a joined connection to the grooves.

It is particularly preferable for the diverter device to be formed by a further base plate with receiving openings and webs which form a joined connection to the end-side groove of the flat tubes.

It is particularly preferable for the diverter device additionally to have a passage plate with continuous slots and a closed cover plate.

It is particularly preferable for the collection and distribution device to have a passage plate with passage openings and webs between the passage openings, a cover plate with refrigerant inlet and outlet openings and a refrigerant feed and refrigerant discharge passage, which are arranged parallel to one another and in the longitudinal direction of the heat exchanger, with the base plate, the passage plate and the cover plate being arranged above one another in such a manner that the openings in the plates are aligned with the flat-tube ends.

It is particularly preferable for the refrigerant inlet openings to be designed as calibrated bores, with the diameter of the bores in particular being variable. It is also preferable for the cover plate and the refrigerant feed and discharge passages to be of single-part design.

According to a further configuration, the heat exchanger, which can be used in particular as an evaporator for motor vehicle air-conditioning systems, comprises flat tubes which have a refrigerant in liquid and/or vapor form flowing through them, corrugated fins arranged between the flat tubes and acted on by ambient air, a collection and distribution device for supplying and discharging the refrigerant, the collection and distribution device comprising a plurality of interrupted plates layered on top of one another, so as to form refrigerant passages, with the ends of the flat tubes being held in receiving openings in a base plate, and a diverter device for diverting the refrigerant in the direction of flow of the ambient air. The heat exchanger in this case comprises a row of flat tubes, with in each case one flat tube having two flow sections which run parallel, through which medium can flow in succession and which are connected via the diverter device, and the collection and distribution device having a calibration device which is arranged between refrigerant inlet and refrigerant outlet and is designed as a cover plate with calibration openings for the refrigerant distribution. It is preferable for the calibration openings to be arranged on the refrigerant inlet side.

According to an advantageous refinement, the calibration openings have different cross sections of flow. The cross sections of flow of the calibration openings preferably increase in size in the direction of the pressure drop of the refrigerant in the feed passage. It is particularly preferable for the cross sections of flow of the calibration openings to be variable as a function of the specific volume of the refrigerant and/or its vapor content.

In another embodiment of the heat exchanger, the flat tubes are designed as serpentine segments, and the diverter device is arranged in the collection and distribution device.

According to a further configuration, the collection and distribution device has a passage plate with continuous passage openings for diverting the refrigerant, and passage openings with webs, a cover plate with refrigerant inlet and outlet openings and a refrigerant feed passage and a refrigerant discharge passage. The passage openings with webs are in this case each arranged flush with the first flat-tube end of the serpentine segment, whereas the continuous passage openings are arranged flush with the second flat-tube end of the serpentine segment, the refrigerant inlet and outlet openings being flush with the passage openings, and the continuous passage openings being covered by the cover plate. It is preferable for the serpentine segments to have two or three diversions over the width.

According to an advantageous embodiment of the heat exchanger, the flat tubes are designed as U-tubes, i.e. with in each case one diversion (over the width). It is preferable for in each case two U-tubes to be connected in series on the refrigerant side, and for in each case two adjacent passage openings, which are assigned to a U-tube outlet and a U-tube inlet, to be in refrigerant communication with one another through a transverse passage in the passage plate.

It is preferable for the width b of the passage openings in the passage plate to be greater than the width a of the receiving openings in the base plate. It is also advantageous for the depth of the groove in the flat-tube ends to be greater than the thickness of the base plate.

It is advantageous for one or more of the following dimensional stipulations to apply to the heat exchanger:

- Width: 200 to 360 mm, in particular 260 to 315 mm
- Height: 180 to 280 mm, in particular 200 to 250 mm
- Depth: 30 to 80 mm, preferably 35 to 65 mm
- Volume: 0.003 to 0.006 $m^3$, in particular 0.0046 $m^3$
- Number of tubes per refrigerant path: 1 to 8, preferably 2 to 4
- Diameter of the heat-exchange passages: 0.6 to 2 mm, in particular 1 to 1.4 mm
- Center-to-center distance of the heat-exchange passages in the depth direction: 1 to 5 mm, preferably 2 mm
- Transverse pitch: 6 to 12 mm, in particular 10 mm
- Tube height: 1 to 2.5 mm, in particular 1.4 to 1.8 mm
- End face surface area SF in the main direction of flow of the second medium: 0.04 to 0.1 $m^2$, in particular 0.045 to 0.07 $m^2$
- Free flow cross-sectional area BF for the second medium: 0.03 to 0.06 $m^2$, in particular 0.053 $m^2$
- Ratio BF/SF: 0.5 to 0.9, in particular 0.75
- Heat-exchanging surface area: 3 to 8 $m^2$, in particular 4 to 6 $m^2$
- Lamella density for corrugated fins: 400 to 1000 $m^{-1}$, in particular 650 $m^{-1}$
- Passage height: 4 to 10 mm, in particular 6 to 8 mm
- Lamella slot length: 4 to 10 mm, in particular 6.6 mm
- Lamella slot height: 0.2 to 0.4 mm, in particular 0.26 mm
- Thickness of the base plate: 1 to 3 mm, in particular 1.5 or 2 or 2.5 mm
- Thickness of the diverter plate: 2.5 to 6 mm, in particular 3 or 3.5 or 4 mm
- Thickness of the cover plate: 1 to 3 mm, in particular 1.5 or 2 or 2.5 mm
- Collection box diameter: 4 to 10 mm, in particular 6 to 8 mm
- Housing wall thickness of a collection box: 1 to 3 mm, in particular 1.5 to 2 mm According to a preferred refinement, the heat exchanger according to the invention is used in an air-conditioning device with at least one air feed element and at least one air passage, which is in particular provided with at least one airflow-control element, in order to transfer heat from air flowing through the air passage to a refrigerant or vice versa. The refrigerant then represents the first medium, while the second medium is formed by the air.

Moreover, there is the possibility of using the heat exchanger according to the invention in any desired air-conditioning device, alone or in combination with at least one further heat exchanger, in which case the at least one further heat exchanger may likewise be a heat exchanger according to the invention or may be a heat exchanger of the prior art.

The invention is explained in more detail below on the basis of exemplary embodiments and with reference to the drawings, in which:

FIG. 1 shows a parallel-flow evaporator in the form of an exploded illustration, FIG. 2 shows an evaporator with serpentine segment (diversion over the width), FIG. 3 shows an evaporator with U-tubes, FIG. 4 shows a section IV-IV through evaporators as shown in FIG. 3, FIG. 5 shows a section V-V through evaporators as shown in FIG. 3, FIG. 6 shows an evaporator with U-tubes connected in series (diversion over the width), FIG. 7 shows a cross-sectional illustration of a heat exchanger, FIG. 8 shows a partial view of a heat exchanger, FIG. 9 shows a partial view of a heat exchanger, FIG. 10 shows a diverter plate, FIG. 11 shows a partial view of a tube plate, FIG. 12 shows an exploded illustration of a tube plate, FIG. 13 shows a cross-sectional illustration of a tube plate, FIG. 14 shows a longitudinal section illustration of a tube plate, FIG. 15 shows a tube plate, FIG. 16 shows a cross-sectional illustration of a tube plate, FIG. 17 shows a partial view of a heat exchanger, FIG. 18 shows a cross-sectional illustration of a tube plate, FIG. 19 shows a tube plate, FIG. 20 shows a tube plate, FIG. 21 shows a tube plate, FIG. 22 shows a tube plate, FIG. 23 shows a tube plate, FIG. 24 shows a partial view of a heat exchanger, FIG. 25 shows a partial view of a tube plate, FIG. 26 shows a plan view of a heat exchanger, FIG. 27 shows a side view of a heat exchanger, FIG. 28 shows a side view of a refrigerant inlet and outlet for a heat exchanger, FIG. 29 shows a plan view of a heat exchanger, FIG. 30 shows a side view of a heat exchanger, FIG. 31 shows a side view of a refrigerant inlet and outlet, FIG. 32 shows a cross section through a flat tube, FIG. 33 shows a cross section through a flat tube, FIG. 34 shows a cross section through a flat tube, FIG. 35 diagrammatically depicts the flow of refrigerant through a flow path, FIG. 36 diagrammatically depicts a header tube, FIG. 37 diagrammatically depicts the leadthroughs of a header tube, FIG. 38 shows a cross section through a header tube, FIG. 39 shows a perspective illustration of a heat exchanger, FIG. 40 shows a heat exchanger, FIG. 41 shows a perspective illustration of a heat exchanger, FIG. 42 shows a perspective illustration of an excerpt from a heat exchanger, FIG. 43 shows a perspective illustration of an excerpt from a heat exchanger, FIG. 44 shows a side view of a heat exchanger, FIG. 45 shows a side view of a heat exchanger, FIG. 46 shows a plan view of a heat exchanger, FIG. 47 diagrammatically depicts a header tube, FIG. 48 shows a side view of a header tube, FIG. 49 shows an end-side view of a header tube, FIG. 50 shows a header tube, FIG. 51 shows a plan view of a header tube, FIG. 52 shows a side view of a header tube, FIG. 53 shows a header tube, FIG. 54 shows a cross section through a header tube, FIG. 55 shows three views of a refrigerant inlet and outlet, FIG. 56 shows three views of a refrigerant inlet and outlet, FIG. 57 shows three views of a refrigerant inlet and outlet, and FIG. 58 shows three views of a refrigerant inlet and outlet.

FIG. 1 shows, as first exemplary embodiment, an evaporator for a motor vehicle air-conditioning system which is operated with $CO_2$ as refrigerant, specifically in the form of an exploded illustration. This evaporator 1 is designed as a single-row flat-tube evaporator and has a multiplicity of flat tubes, of which just two flat tubes 2, 3 are illustrated. These flat tubes 2, 3 are designed as extruded multichamber flat tubes which have a multiplicity of flow passages 4. All the flat tubes 2, 3 have the same length I and the same depth t. A groove 5, 6 is machined into the flat tube 2 at each tube end 2*a*, 2*b*, symmetrically with respect to the center axis 2*c*. Between the individual flat tubes 2, 3 there are corrugated fins 7, which are acted on by ambient air in the direction of the arrow L. The corrugated fins 7 are continuous in the depth direction, although they may also be interrupted, for example in the center of the depth t, in order to ensure improved condensate run-off and/or thermal isolation.

In the drawing, a base plate 8, in which a first row of slot-like apertures 9*a*-9*f* and a second row of similar apertures 10*a*-10*f* are arranged, is illustrated above the flat tubes 2, 3. The openings 9*a* and 10*a*, 9*b* and 10*b*, etc. are located one behind the other in the depth direction (airflow direction L) and in each case leave between them webs 11*a*, 11*b*-11*f*. In terms of their width in the depth direction, these webs 11*a*-11*f* correspond to the width of the cutout 5 of the tube ends 2*a*. The number of openings 9*a*-9*f* and 10*a*-10*f* corresponds to the number of flat tubes 2, 3.

What is known as a diverter plate 12, in which two rows of apertures 13*a*-13*f* and 14*a*-14*f* (partially covered) are arranged, is illustrated above the base plate 8 in the drawing. The arrangement of the apertures 13*a*-*f* and 14*a*-*f* corresponds to the arrangement of the apertures 9*a*-9*f* and 10*a*-10*f*, respectively, but the width b and depth of the apertures 13*a*-*f* and 14*a*-*f* are greater than the corresponding dimensions of the apertures 9*a*-9*f* and 10*a*-10*f*, respectively, which in each case only have a width a corresponding to the thickness of the flat tubes 2, 3. Webs 15*a*, 15*f* are partially left between the apertures 13*a*, 14*a*, 13*b*, 14*b*-13*f* and 14*f*. The dimensions of these webs 15*a*-15*f* in the depth direction are smaller than the corresponding dimensions of the webs 11*a*-11*f* of the base plate 8.

What is referred to as a cover plate 16, which includes a first row of refrigerant inlet apertures 17*a*, 17*d* and a second row of refrigerant outlet apertures 18*c*, 18*f*, is illustrated in the drawing above the diverter plate 12. These apertures 17*a*, 17*f* and 18*a*, 18*f* are preferably designed as circular bores with a diameter matched to the desired refrigerant distribution and quantitative flow.

Finally, a collection box 19 with a housing and in each case one collection chamber 20, 21 for supplying and discharging the refrigerant is located above the cover plate 16 in the drawing. The collection box has apertures 22*a, d* and 23*c, f*, illustrated by dashed lines, the position and size of which correspond to the apertures 17*a, d* and 18*c, f*, at the underside of both collection chambers.

In the drawing, a further base plate 24, which analogously to the first base plate 8 has two rows of slot-like apertures 25*a-f* and 26*a-f*, is illustrated beneath the flat tubes 2, 3 in the drawing. Between the apertures 25*a* and 26*a* to 25*f* and 26*f* there are likewise webs 27*a-f* (partially covered), the width of these webs in the depth direction corresponding to the width of the cutout 6 in the end of the flat tube 2. A further diverter plate 28, which has continuous diverter passages 29*a*-29*f*, is illustrated in the drawing below the second base plate 24. These diverter passages 29*a-f* extend over the entire depth t of the flat tubes 2, 3.

Finally, a cover plate 30, which does not have any apertures, but rather closes off the diverter passages 29*a*-29*f* with respect to the environment surrounding the heat exchanger, is illustrated at the bottom of the drawing.

The above-described individual parts of the evaporator 1 are assembled in the following way: the base plate 8 is fitted onto the flat-tube ends 2*a*, etc., so that the webs 11*a*-11*f* come to lie in the cutouts 5 in the flat-tube ends. Then, the diverter plate 12, the cover plate 16 and the collection box 19 with the collection chambers 20, 21 are stacked on top of the base plate 8. In a similar way, the lower base plate 24 is pushed onto the flat-tube ends 2*b*, so that the webs 27*a*-27*f* come to lie in the cutouts 6; then, the passage plate 28 and the cover plate 29 are attached. After the evaporator 1 has therefore been assembled, it is soldered to form a fixed block in a soldering furnace. During the soldering process, the plates are held in position with respect to one another by a positive or nonpositive clamping action. However, it is also possible firstly to assemble the end piece comprising base plate, diverter plate and cover plate, and then to connect it to flat tubes.

The profile of the refrigerant flow is illustrated by way of example on the basis of a row of arrows V1-V4 on the front side of the evaporator, by diverter arrows U1-U5 in the diverter passages 29*a*, 14*a-b*, 29*b*, 13*b-c*, 29*c* and the arrows R1, R2 and R3 on the rear side of the evaporator 1. The refrigerant, in this case therefore $CO_2$, flows through the evaporator, starting from the distribution chamber 20, for example initially on the front side from the top downward, as indicated by V1, V2, V3 and V4, is then diverted in the diverter passage 29*a*, as indicated by U1, onto the rear side of the evaporator 1, where it flows from the bottom upward. The two first flow sections of this flow path are therefore arranged one behind the other in the main direction of flow of the air. Then, the refrigerant is diverted in the direction indicated by U2 to the adjacent flat tube, through which the refrigerant likewise initially flows from the top downward and then, after diversion indicated by U3, from the bottom upward. The two flow-path sections in this tube lie next to the first two flow-path sections in the main direction of flow of the air. After a diversion as indicated by U4, the refrigerant flows through the flat tube 2 in its sections 2*d*, 2*e* with an intervening diversion indicated by U5 and finally flow into the collection chamber 21 as indicated by arrows R1, R2 and R3. The arrangement of sections of the flow path which has just been described adjacent to one another in the main direction of flow of the air produces a small number of hydraulically parallel flow paths—in this exemplary embodiment two flow paths—which facilitates more uniform application of medium to the flow paths of the heat exchanger, since an identical or at least similar refrigerant pressure for this purpose is required in particular only at two locations of the distribution chamber 20.

FIG. 2 shows a further exemplary embodiment of the invention, specifically an evaporator 40 in which the above-mentioned flat tubes are designed as serpentine segments 41. A serpentine segment 41 of this type comprises four flat-tube limbs 42, 43, 44 and 45, which are connected to one another by three diverter bends 46, 47, 48. Corrugated fins 49 are arranged between the individual flat-tube limbs 42-45. The further parts of the evaporator are likewise illustrated in the form of an exploded illustration, i.e. a base plate 50, a diverter plate 51, a cover plate 52 and collection chambers 53, 54 for a refrigerant feed and discharge. The base plate 50 has a front row of slot-like apertures 55*a*, 55*b* and 55*c*, behind which there is a second row (partially covered) of corresponding apertures. Webs 56*a*, 56*b* and 56*c* are in turn left between the two rows of apertures, these webs corresponding with cutouts 57 and 58 in the ends 42*a* and 45*a* of the serpentine segment 41. These flat-tube ends are therefore fitted through the apertures in the base plate, with the webs coming to lie in the cutouts. The base plate 50 is followed at the top by the diverter plate 51, which has an aperture 59*a* which is flush with the aperture 55*a* in the base plate 50. Behind the aperture 59*a* in the depth direction there is (partially covered) a corresponding aperture, which is separated from the aperture 59*a* by a web 60*a*. This web 60*a* is once again smaller than the cutout 58 in the flat-tube limb 42. Adjacent to the aperture 59*a*, at a distance which corresponds to the distance between the flat-tube ends 42*a*-45*a*, there is a diverter passage 61 which extends over the entire depth of the flat-tube limb 45. Adjacent to the diverter passage 61 there then follows an aperture 59*b*, the size of which corresponds to the aperture 59*a*. It corresponds to the next flat-tube serpentine segment, which is not shown here. Above the diverter plate 51 is the cover plate 52, which in the front row has two refrigerant feed apertures 62, 63 and in the rear row has two refrigerant outlet apertures 64 and 65. The size and position of the latter correspond to the openings shown in dashed lines in the drawing (without any reference numbers) at the collection chambers 53, 54.

The refrigerant flow route is illustrated by arrows: first of all the refrigerant leaves the collection chamber 53 as indicated by the arrow E1, then follows the direction of the arrows E2, E3, E4 and passes into the front flow section of the flat-tube limb 42 and then flows through the entire serpentine segment 41 on its front side and emerges from the final limb 45 at E6, passes into the diverter passage 61, where it is diverted over the depth in accordance with arrow U, before then flowing through the rear side of the serpentine segment, as indicated by arrow R1, i.e. in the opposite direction to on the front side. Finally, this stream of refrigerant passes into the collection chamber 54 as indicated by the arrow R2, i.e. through the aperture 64.

This construction therefore diverts the refrigerant over the width of the evaporator, i.e. transversely to the main direction of flow of the air, specifically initially from the right to the left on the front side in the drawing, and then from the left to the right on the rear side. As has already been mentioned above, one or more serpentine segment sections which are not illustrated follow the serpentine segment section 41 illustrated in the drawing.

FIG. 2 illustrates just one serpentine segment section 41, arranged on the right in the drawing. Contrary to the description given above, it is possible for the next serpentine segment section following this serpentine segment section 41 also to have refrigerant flowing through it in the opposite direction over the width, i.e. from the left to the right or from the outside inward in the drawing. On viewing the end face of the evaporator, therefore, the latter would therefore have refrigerant flowing through it symmetrically from the outside inward on the front side, then the two refrigerant streams can then be combined in the center—in a common diverter passage which then functions as a mixing space—and diverted over the depth and can flow from the inside back outward on the rear side.

FIG. 3 shows a further exemplary embodiment of the invention, specifically an evaporator 70, the flat tubes of which are formed from individual U-tubes 71*a*, 71*b*, 71*c* etc. This is therefore a serpentine segment section with a diversion and two limbs 72 and 73. The ends of these flat-tube limbs 72 and 73 which cannot be seen in the drawing are secured in an analogous way, i.e. as described above, in a base plate 74 with corresponding receiving parts. A diverter plate 75 is arranged above the base plate 74 and has, in alternation, two slot-like apertures 76, 77 which lie one behind the other in the depth direction, leaving a web 78 and a diverter passage 79 which continues through in the depth direction. In this illustration, the cover plate—similar to the exemplary embodiments described above—has been omitted.

The flow of the refrigerant then follows the direction of the arrows, i.e. the refrigerant enters the front flow section of the U-tube 71*a* at E, initially flows downward, is diverted at the bottom, then flows upward and passes into the diverter passage 79, where it is diverted as indicated by arrow U before then flowing downward on the rear side, where it is diverted and then flows upward again in order to pass through the aperture 77 as indicated by arrow A. The supply and discharge of the refrigerant is described on the basis of the following figure, corresponding to sections IV-IV and V-V.

FIG. 4 shows a section on line IV-IV through the evaporator shown in FIG. 3, in the form of an enlarged illustration and with the addition of a cover plate 80 and a collection box 81 and a collection box 82. The other parts are denoted by the same reference numerals as in FIG. 3, i.e. the diverter plate by 75, the base plate by 74 and the flat-tube limb by 71*c*. The diverter plate 75 has two apertures 76*c* and 77*c*, which are separated from one another by the web 78*c*. In the cover plate 80 there is a refrigerant inlet aperture 83, which is arranged flush with a refrigerant aperture 84 in the collection box 81. In a similar way, a refrigerant outlet aperture 85 in the cover plate 80 is arranged flush with a refrigerant aperture 86 in the collection box 82 on the side of the collection box 82. The collection boxes 81, 82 are soldered tightly and in a pressure-resistant manner to the cover plate 80, as are the other parts 80, 75, 74 and 71*c*.

FIG. 5 shows a further section, on line V-V in FIG. 3, i.e. through the diverter passage 79*d*. Identical parts are once again denoted by identical reference numerals. It can be seen that the refrigerant, illustrated by the arrows, flowing from the bottom upward in the left-hand flat-tube section, is diverted to the right in the diverter passage 79*d* and passes into the right-hand or rear section of the flat-tube limb 71*c*, where it flows from the top downward.

This mode of design of the evaporator shown in FIGS. 3, 4 and 5 with simple U-tubes therefore in each case allows simple diversion over the width and over the depth.

FIG. 6 shows, as a further exemplary embodiment of the invention, an evaporator 90, which is once again constructed from U-tubes 91*a*, 91*b*, 91*c*, etc. The ends of the U-tube limbs are once again—although this is not illustrated in the drawing—received in a base plate 92, above which there is a diverter plate 93. The diverter plate 93 has a configuration of apertures in which a pattern repeats itself after in each case two U-tubes, i.e. for example 91*a* and 91*b*. The following text describes this pattern, specifically starting in the top left-hand corner of the drawing: two apertures 94 and 95 arranged one behind the other in the depth direction are located there, adjoined in the width direction by the apertures 96 and 97 and 98 and 99, the apertures 96 and 98, in the width direction, being in refrigerant communication via a transverse passage 101, and the apertures 97 and 99 being in refrigerant communication via a transverse passage 100, resulting in two H-shaped apertures. A continuous diverter passage 102 is arranged adjacent to the H-shaped apertures. The pattern of apertures 94-102 which has just been described is then repeated. This configuration of apertures enables in each case two U-shaped refrigerant tubes to be connected in series on the refrigerant side, i.e. in this case the U-tubes 91*a* and 91*b*. The refrigerant profile is illustrated by arrows: the refrigerant enters the front part of the left-hand limb of the U-tube 91*a* at A and flows downward, is diverted, flows back upward and is diverted into the next U-tube 91*b* in the diverter plate 93 via the transverse passage 101, i.e. following the arrow B. In this next U-tube 91*b*, it flows downward, is diverted, then flows back upward and passes into the diverter passage 102, where, following arrow C, it is diverted over the depth and then flows through the rear part of the two flat-tube limbs 91*b* and 91*a*, before finally emerging again at D. The cover plate and the refrigerant feed and discharge have been omitted here in order to provide a better illustration of the flow of refrigerant. This series connection of two U-tubes on the one hand allows triple diversion over the width and on the other hand means that each U-tube limb is received in the base plate, resulting in a pressure-stable design. Of course, this pattern can also be used to realize four or more diversions over the width, which merely requires U-shaped flat tubes. The upper diversion therefore in each case takes place in the passage plate 93.

FIG. 1 illustrates collection chambers 20 and 21, and FIG. 4 illustrates collection boxes 81 and 82, for supplying and discharging refrigerant. According to one refinement of the invention, it is possible for a distribution device in accordance with DE 33 11 579 A1, i.e. a coiled profiled-section body, or in accordance with DE 31 36 374 A1 in the name of the present Applicant, known as a push-in body, to be used in particular on the respective refrigerant inlet side, so that a uniform refrigerant distribution and therefore also a uniform temperature distribution is achieved at the evaporator. In this context, it may be advantageous if in each case a plurality of, for example four, adjacent refrigerant inlet apertures are supplied via a common chamber; this enables four times five, i.e. 20, refrigerant inlet apertures to be supplied with refrigerant in the case of a profiled-section body with, for example, five passages. For this purpose, the (five) passages, which initially run axially parallel, are in each case turned (through approximately 72°) behind a group of refrigerant inlet apertures, so that the adjacent chamber comes into communication with the next group of refrigerant inlet apertures.

FIG. 7 shows a cross section through a heat exchanger 110 with an end piece 120, which has a base plate 130, a diverter plate 140, a cover plate 150 and collection boxes 160, 170. A tube 180 is received in two apertures 190, 200 in the base plate 130, with a cutout 210 in one end of the tube 180 bearing against a web 220 of the base plate 130. The cutout 210 is slightly higher than the web 220, so that the tube end projects slightly above the base plate 130. Heat-exchange passages (not shown) in the tube 180 communicate with through-passages 230, 240 in the diverter plate 140. The through-passages 230, 240 are in turn connected via cutouts 250, 260 in the cover plate 150 and cutouts 270, 280 in the housings 290, 300 of the collection boxes 160, 170 to collection chambers 310, 320. To improve manufacturing reliability, the edges of the cutouts 250, 260 are provided with extensions 330, 340 which engage into the cutouts 270, 280, resulting in an orientation of the collection boxes 160, 170 with respect to the cover plate 150, in such a manner that the cutouts 250 and 260 in the cover plate 150 are flush with the cutouts 270 and 280, respectively, in the collection-box housings 290, 300.

FIG. 8 shows a refinement of the heat exchanger from FIG. 6. In the heat exchanger 410, the configuration of diverter passages likewise adopts a pattern which repeats itself after in each case two U-tubes 420, corresponding to a flow path through the heat exchanger 410. In this case, however, in each case two adjacent flow paths are arranged mirror-symmetrically with respect to one another. This means that either the through-passages 430, 440 of a flow path 450 come to lie next to the through-passages 460, 470 of an adjacent flow path 480, or a diverter passage 490 of a flow path 500 comes to lie next to a diverter passage 510 of an adjacent flow path 520. In the latter case, it is possible for the adjacent diverter passages 530, 540 to be connected to a connecting passage 545, so that mixing and flow compensation is realized between the participating flow paths 550, 560. This is particularly effective in a region of the edge of the heat exchanger, since the flow conditions there may otherwise be particularly unfavorable for the performance of a heat exchanger. In other regions of the heat exchanger, mixing of the first medium by means of a connection passage between two adjacent diverter passages is also possible. The flow paths 450, 480, 485, 500, 520, 550, 560 in each case comprise eight sections, whereas the flow path 445 comprises just four sections, in order to reduce a pressure drop along the flow path 445, likewise on account of the unfavorable flow conditions in the edge regions of a heat exchanger. In this case, mixing with the adjacent flow path 450 is likewise applied.

FIG. 9 shows a further example of a connection arrangement for flow-path sections of a heat exchanger 610. In this case, the flow-path sections 620 on the inlet side 630 of the heat exchanger 610 have a smaller cross section of flow than the flow-path sections 640 on the outlet side 650. By way of example, if the heat exchanger 610 is used as an evaporator, this asymmetry serves to match the cross sections of flow to the density of the first medium along the flow paths 660.

FIG. 10 shows a further example of a connection arrangement for flow-path sections of a heat exchanger 710, produced by a configuration of through-passages and diverter passages of a diverter plate 720. In this case, the flow paths 730 and 740 are in each case oriented in such a way that an inlet and an outlet for the first medium, produced by through-passages 750, 760 and 770, 780, respectively, are arranged as far away as possible from edges 790 or 800 of the heat exchanger 710.

FIG. 11 shows a further example of a connection arrangement for flow-path sections of a heat exchanger 810, produced by a configuration of through-passages 812 and diverter passages 814 of a diverter plate 820. In this case, the flow-path sections are connected to one another in the following order: 1 (downward)-2 (upward)-3 (downward)-4 (upward)-5 (downward)-6 (upward) etc.

Figure 16:
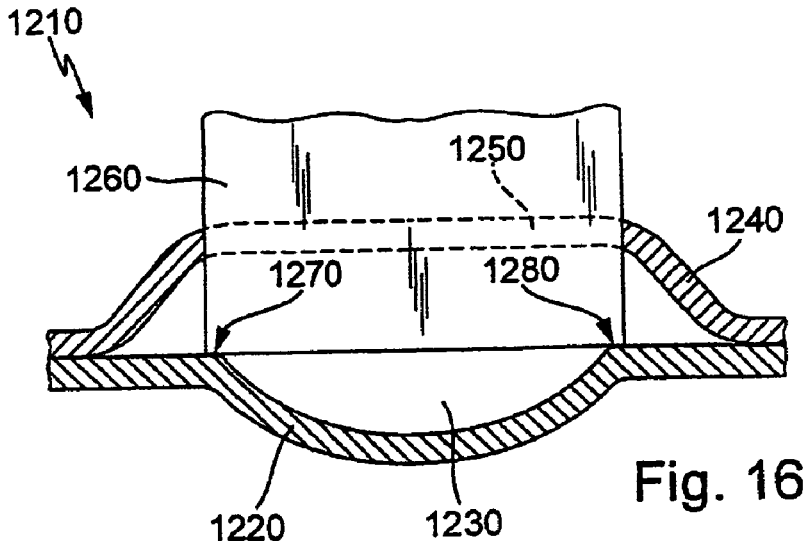

FIG. 16 shows a further possible option for the configuration of a two-part tube plate 1210. In this case, the diverter plate is formed integrally with the cover plate, producing a plate 1220. The plate has a diverter passage 1230 for diversion over the depth, which is produced by a curvature. The base plate 1240 is likewise curved, so that the tube 1260 received in the cutout 1250 in the base plate 1240 is held more securely and therefore in a manner which is more resistant to pressure. The tube 1260 in this case butts against the edge 1270, 1280 of the diverter passage 1230, since the curvature in the plate 1220 is not as wide as the curvature in the plate 1240.

Figure 17:
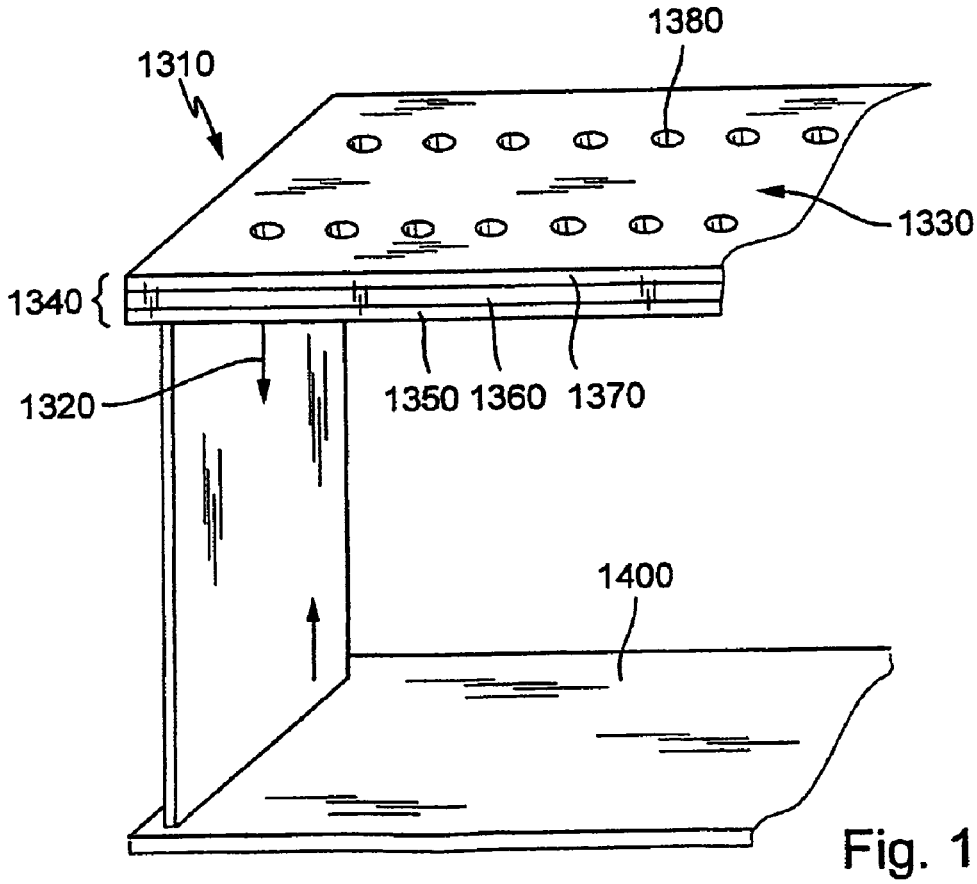

FIG. 17 shows a heat exchanger 1310 of purely countercurrent design. The pure countercurrent design is distinguished by the fact that diversions take place only over the depth but not over the width. In this context, it is irrelevant how many sections the flow paths comprise. The flow paths may, for example, comprise in each case four sections, in which case three diversions per flow path are required over the depth. The heat exchanger 1310 has flow paths 1320 with in each case one diversion over the depth and accordingly with in each case two flow-path sections, which are aligned with one another in the main direction of flow of the second medium. The upper end piece 1330 has a tube plate 1340 and two collection boxes, which are not shown for the sake of clarity. The tube plate comprises a base plate 1350, a diverter plate 1360, which in this case serves merely to pass through the first medium, and a cover plate 1370 with apertures 1380 for connection to the collection boxes. The lower end piece 1390 comprises only a plate 1400, in which a base plate, a diverter plate and a cover plate are integrated. The structure of the plate 1400 is explained on the basis of FIGS. 18 and 19 below.

Figure 18:
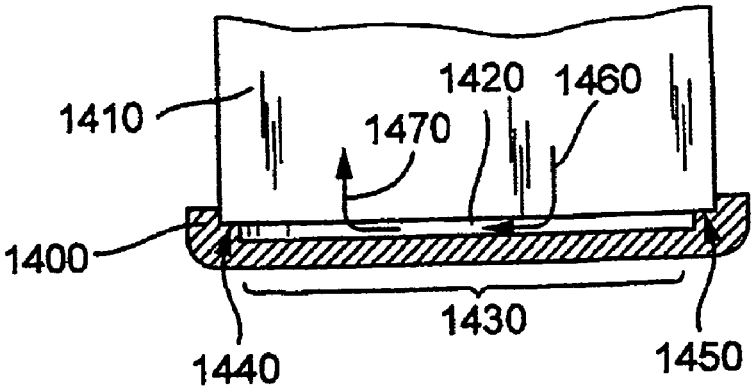
Figure 19:
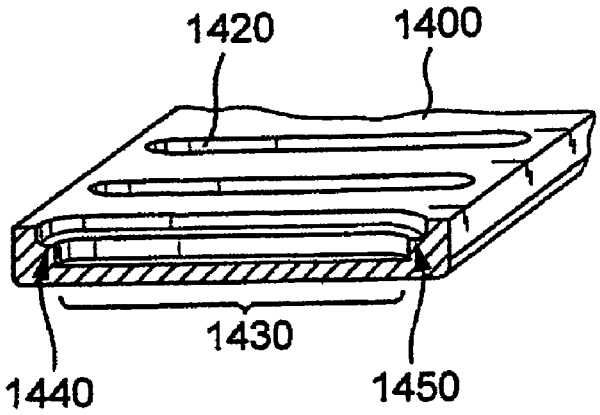

FIG. 18 shows a cross section through and FIG. 19 a cut-away oblique view of the plate 1400 from FIG. 17. A tube 1410 is received in a cutout 1420, which simultaneously serves as a diverter passage for the first medium, the diverter passage being closed off with respect to the outside by the region 1430 of the plate 1400. A narrowing provides the cutout 1420 with edges 1440, 1450 which serve as a stop for the tube 1410. This produces a single-part tube plate of very simple design and with a high ability to withstand pressure. The tube 1410 in this case serves to form two sections (downward 1460 and upward 1470) of a flow path.

Figure 20:
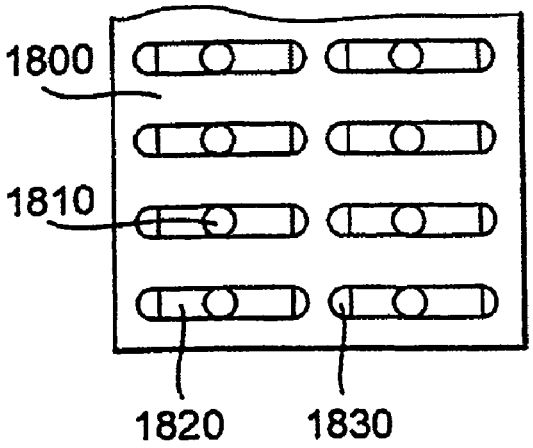

FIG. 20 shows a tube plate 1800 of similar construction, which is likewise of single-part structure and over and above the diverter passages 1820 and the tube stops 1830 also has apertures 1810 in the region of the cover plate in order to allow it to be connected to one or two collection boxes.

To summarize, the invention allows the production of a heat exchanger which comprises a row of tubes (to realize heat-exchange passages), two plates (the tube plates) and two tubes (the collection boxes). This makes it possible to realize an extremely simple and, moreover, pressure-stable structure of the heat exchanger.

FIGS. 21 to 24 show exemplary embodiments of a tube plate which involves little outlay on material and, for this reason, low materials costs and a low weight.

Figure 21:
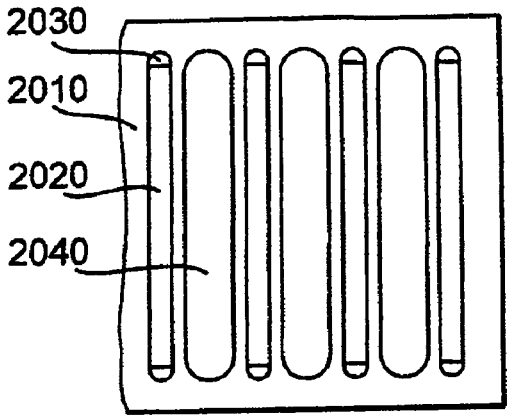
Figure 22:
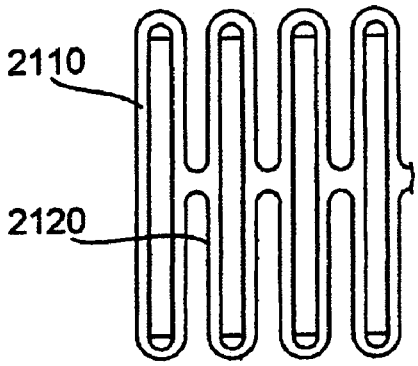
Figure 23:
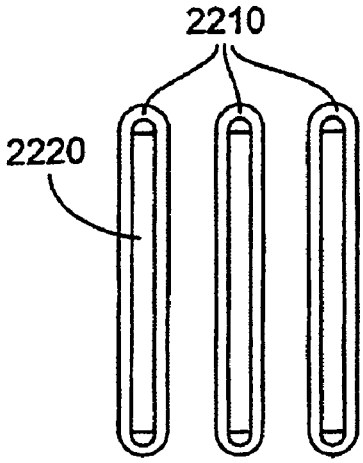
Figure 24:
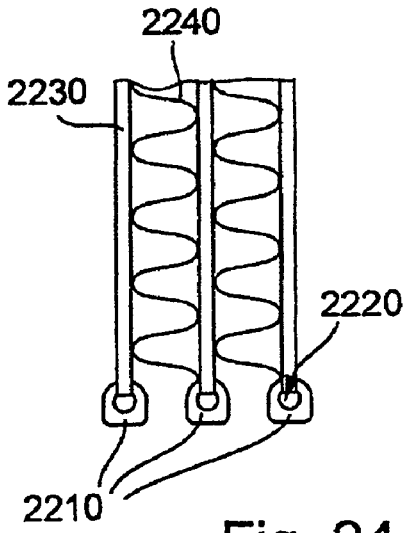

The tube plate 2010 in FIG. 21 has, between the tube-receiving cutouts 2020 with the tube-stop edges 2030, cutouts formed as apertures 2040 in order to save material. For the same reason, in the case of the tube plate 2110 shown in FIG. 22, cutouts formed as lateral notches 2120 are provided. The tube plate 2210 in FIG. 23 and FIG. 24 is completely separated between the tube-receiving cutouts 2220. In this case, the tubes 2230 may under certain circumstances be stabilized by the corrugated fins 2240 alone.

Figure 25:
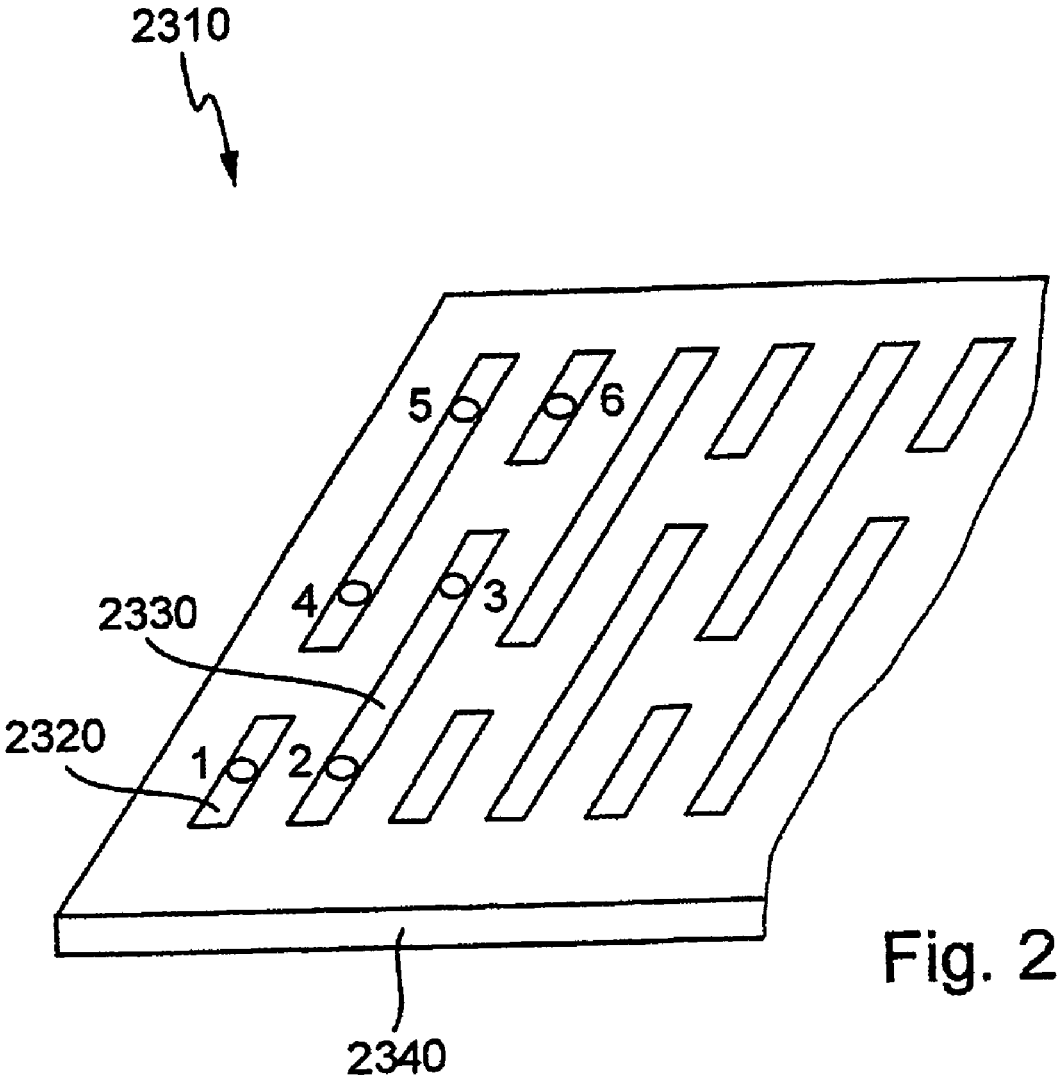

FIG. 25 shows a further example of a connection arrangement for flow-path sections of a heat exchanger 2310, produced by a configuration of through-passages 2320 and diverter passages 2330 of a diverter plate 2340. In this case, the flow-path sections are connected to one another in the following order: 1 (downward)-2 (upward)-3 (downward)-4 (upward)-5 (downward)-6 (upward). It is possible to provide a tube for each flow-path section. However, it is preferable for a tube to include two or more flow-path sections, for example the flow-path sections 1, 4 and 5 or the flow-path sections 2, 3 and 6. In this exemplary embodiment, flat tubes are particularly suitable for this purpose. Any further desired connection arrangements for flow-path sections are also conceivable over and above those illustrated.

Figure 26:
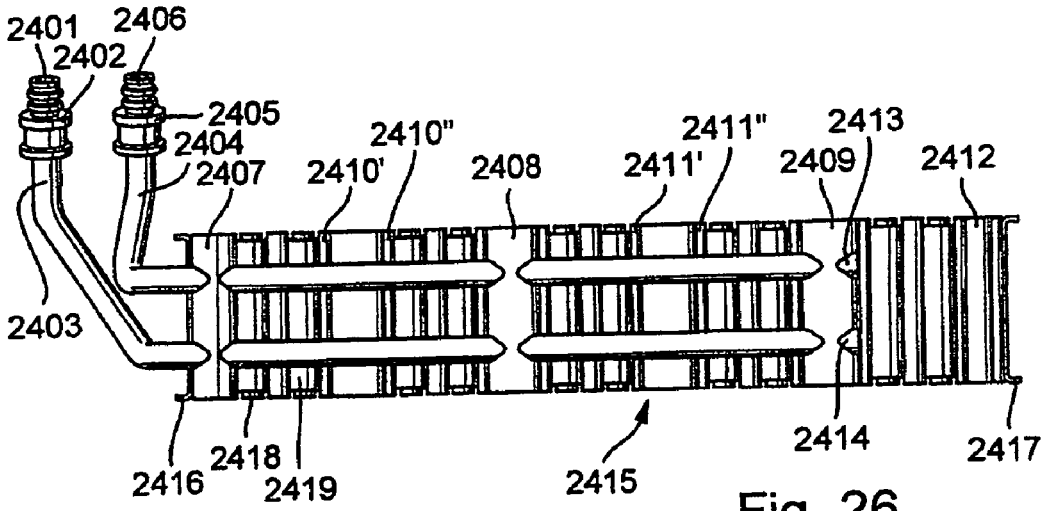

FIG. 26 shows a plan view of a heat exchanger, in particular an evaporator, in which the refrigerant is supplied via the refrigerant inlet 2401 and the adjoining refrigerant inlet tube 2403 from the coolant circuit of, for example, an air-conditioning unit. In this case, the entry section has a cutting seal which in combination with, for example, a releasable coupling connection 2402, is connected to the pipeline system leading onward. The refrigerant inlet tube 2403 opens out in a first header tube 2407 and is then led onward to the two header tubes 2408 and 2409. The refrigerant inlet tube is closed off in a gastight and liquid-tight manner at position 2407. This is effected in particular by installing a soldered-in separating element or by welding. It is also within the scope of the present invention to close the tube by bending.

According to a particularly preferred embodiment, the header tubes 2407, 2408 and 2409 have at least one separating element (not shown), which is arranged, for example, in the center of the header tube. As a result, the header tubes are divided into at least two sections, from which the coolant is introduced into the tube 2419 and passed via the heat-exchange passages of the tube 2419 into the transverse distributor 2410', 2410", 2411', 2411" and 2412. From there, the refrigerant, which has already to a certain degree taken up heat from the medium flowing around it, flows, for example, into the rear region of the transverse distributor, from which it is in turn passed into the rear heat-exchange passages of the tube 2419. At the end, these flow routes open out into the outlet section of the header tube 2407, 2408 and 2409 and are returned via the refrigerant outlet tube 2404 into the pipeline system of the air-conditioning system. In this case too, by way of example, the refrigerant return tube has a seal 2406 and, for example, a coupling system 2405 for connection to the pipeline system. In addition to the refrigerant-carrying constituents of the heat exchanger, this embodiment also has frame elements 2416 and 2417. Reference numeral 2418 denotes the position of the cooling fins for the apparatus.

Figure 27:
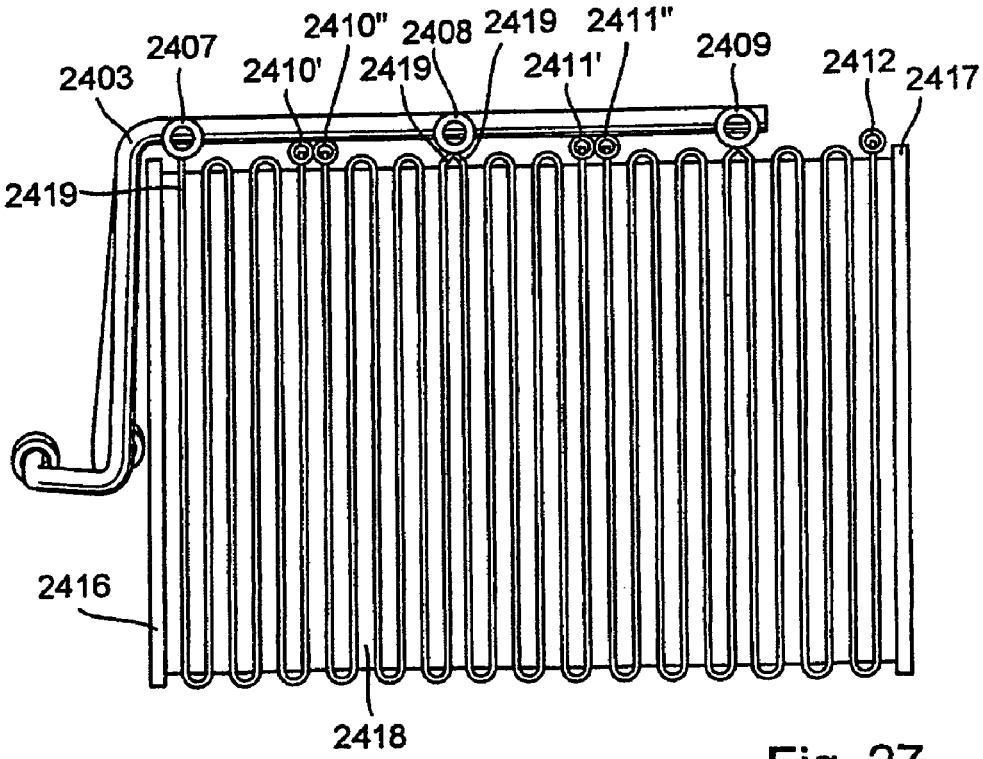

Corresponding to the plan view shown in FIG. 26, FIG. 27 shows a side view of a heat exchanger in which in particular a preferred embodiment of the header tubes and the transverse distributors is illustrated. In this case, the header tubes and the transverse distributors have a round cross section, with in each case two through-flow devices 2419 opening out in particular into the header tubes 2408 and 2409. According to this exemplary embodiment, the tube is in particular a flat tube which, bent in serpentine form, provides the connection between the header tube and the transverse distributor. In particular cooling fins 2418 which improve the heat transfer between the medium flowing around the tubes, for example air, and the refrigerant flowing inside the through-flow device, are arranged between the respective serpentine sections of the tube.

According to a particularly preferred embodiment, the cooling fins are configured in such a manner that they likewise extend in serpentine form between the serpentine sections of the tubes and, over the depth of the heat exchanger, are additionally provided with what are known as gills, i.e. with slots, which serve in particular to generate turbulence and therefore to improve the heat transfer between the medium flowing around and the heat-dissipating cooling fins.

In accordance with the illustration presented in FIG. 27, it also becomes clear that the tubes, in particular the flat tubes, have a certain depth of penetration into the transverse-distribution tubes and/or into the header tubes. Furthermore, the end pieces of the serpentine sections which open out in the header tube or in the transverse distribution tube are made longer in order to produce a predetermined spacing between the header tube or the transverse-distribution tube and the base body of the heat exchanger through which the refrigerant is substantially flowing.

Figure 28:
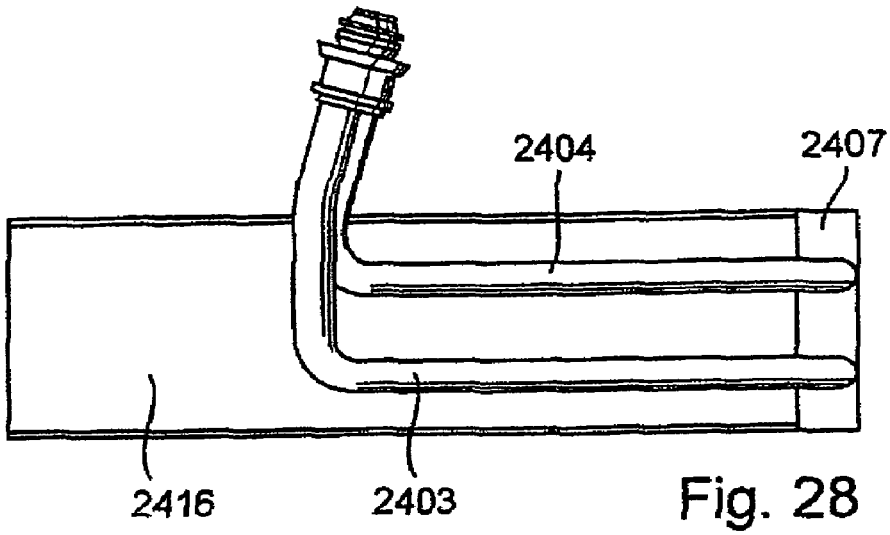

FIG. 28 shows a side view from the left of an apparatus for exchanging heat in accordance with FIG. 26 and FIG. 27. As well as the frame element 2416, it is also possible to recognize the refrigerant outflow 2404 and the refrigerant inflow 2403, as well as the header tube 2407.

Figure 29:
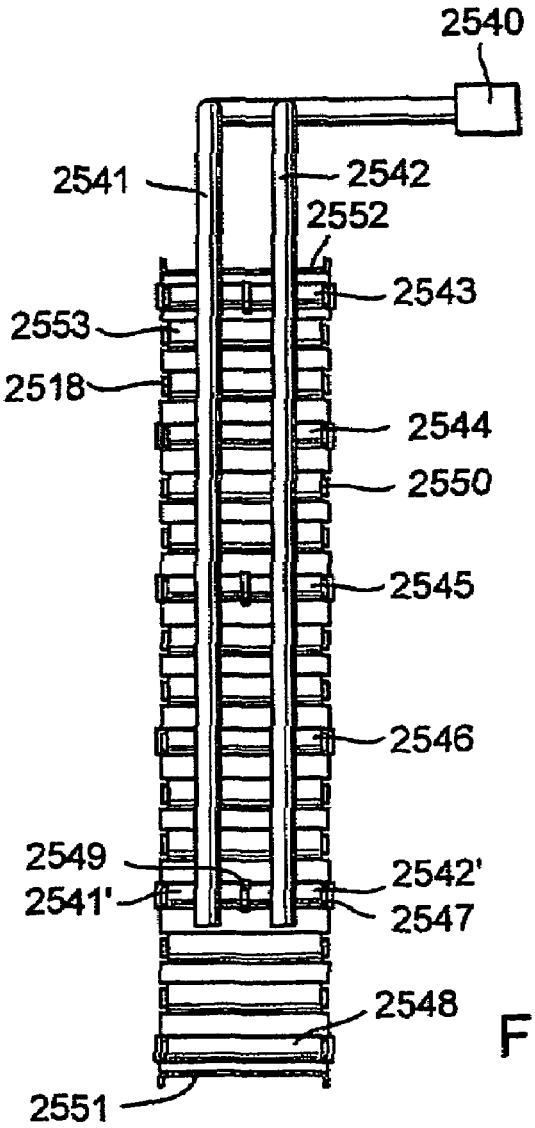

FIG. 29 shows an alternative embodiment of a heat exchanger, in which in addition to the refrigerant inlet 2541 it is also possible to discern the refrigerant outlet 2542, a tube-connecting device 2540 and the header tubes 2543, 2545 and 2547. According to a particularly preferred embodiment, this illustration also shows the separating elements 2549 which divide the header tubes 2543, 2545 and 2547 into an inlet section 2541' and an outlet section 2542'. The tube 2553 connected to the header tube 2543, 2545 and 2547 opens out in the transverse-distribution tubes 2544, 2546 and 2548. Furthermore, FIG. 29 shows the frame elements 2551 and 2552 and the cooling fins 2518, which project beyond the tube 2553.

According to a particularly preferred embodiment, the transverse distributors and the header tubes are closed off in a fluid-tight manner at their outer boundaries by means of additional separating elements. These separating elements are preferably connected to the header tube, transverse-distribution tube or the coolant inlet or coolant outlet tube in a cohesive, positive and/or nonpositive manner.

Figure 30:
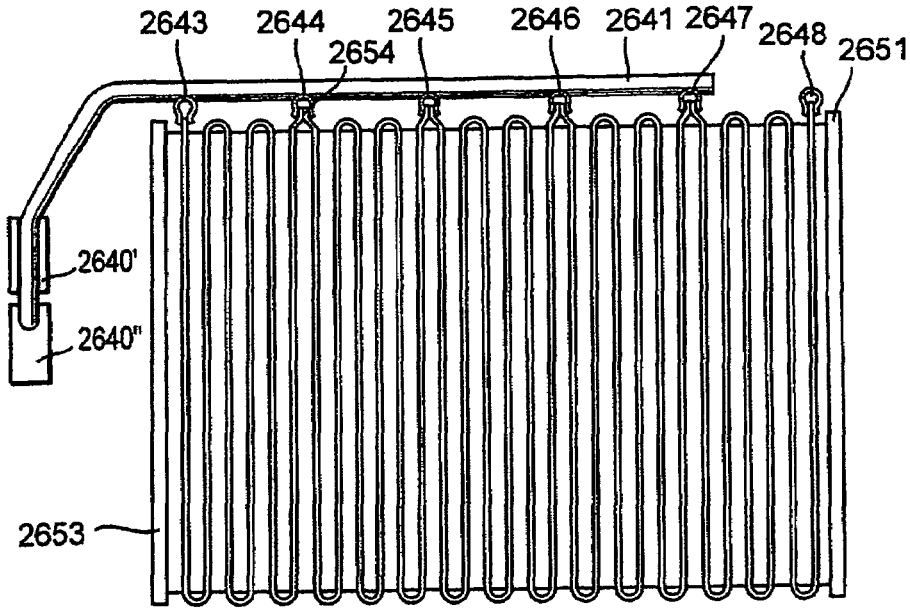

FIG. 30 shows the alternative embodiment as shown in FIG. 29 in side view, illustrating in particular the connection device 2640' and 2640" for the refrigerant inlet and refrigerant outlet. It is also possible to recognize the Ω-shaped configuration of the header tubes 2643, 2645 and 2647 and of the transverse-distribution tubes 2644, 2646 and 2648.

According to a particularly preferred embodiment, these tubes have a Ω-shaped cross section, in the narrowed region of which there are recesses which receive, for example, the heat-exchange tubes. In this case, it should be noted in particular that the heat-exchange tubes have a predetermined depth of penetration into the header tube or the transverse-distribution tube, and that to assemble the components during production of the heat exchanger, it is possible to clamp the through-flow device using the header tubes or transverse distributors. According to a particularly preferred embodiment, the depth of penetration is 0.01 to 10 mm, preferably 0.1 to 5 mm and particularly preferably 0.15 to 1 mm. Furthermore, the header tubes 2645 and 2647 or the transverse distributors 2644 and 2646 have embodiments in which two through-flow devices open out into the interior of the header tubes or transverse distributors. In this case, the outlet limbs of the header tubes or the transverse distributors are matched to the inlet angle of the tubes, so that they extend parallel to the transverse distributor at least in a section.

Figure 31:
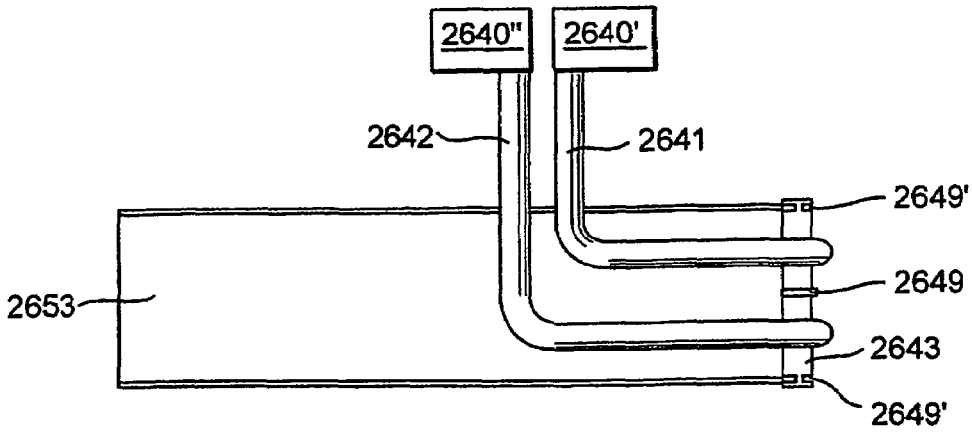

FIG. 31 illustrates a side view of the alternative embodiment from the left, as seen in FIG. 30, illustrating, in addition to the connecting device 2640' and 2640", the refrigerant inlet 2641 and refrigerant outlet 2642. It is also possible to recognize the separating element 2649 and the outer separating elements of the header tube 2643, bearing reference numerals 2649' and 2649". The frame element 2653 laterally closes off the apparatus for exchanging heat.

Figure 32:
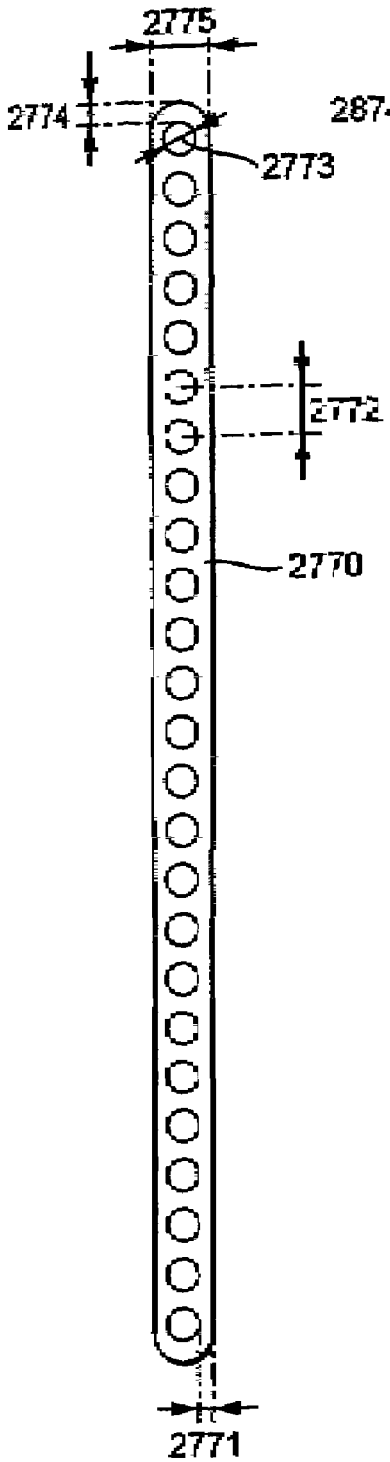
Figure 33:
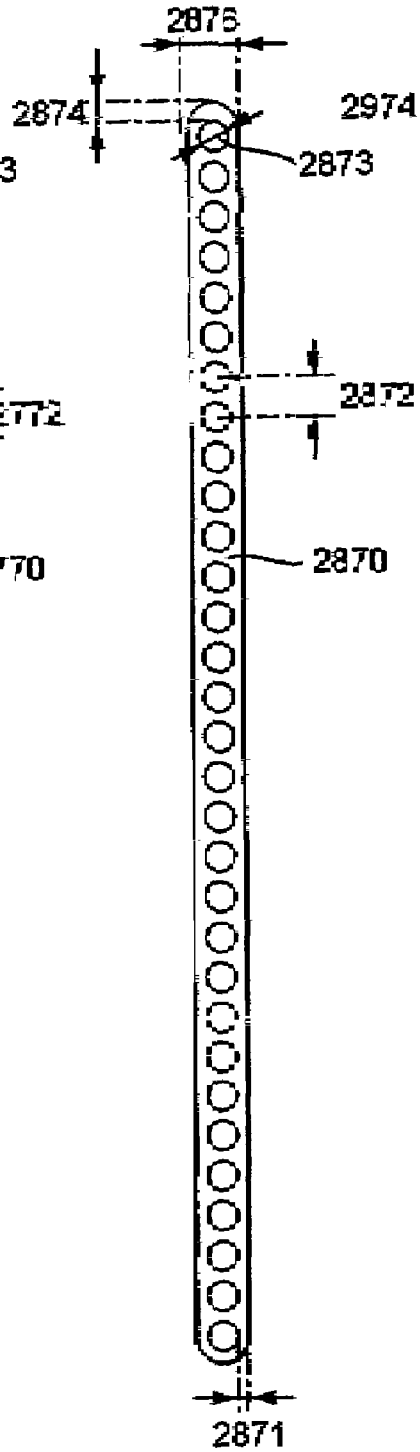
Figure 34:
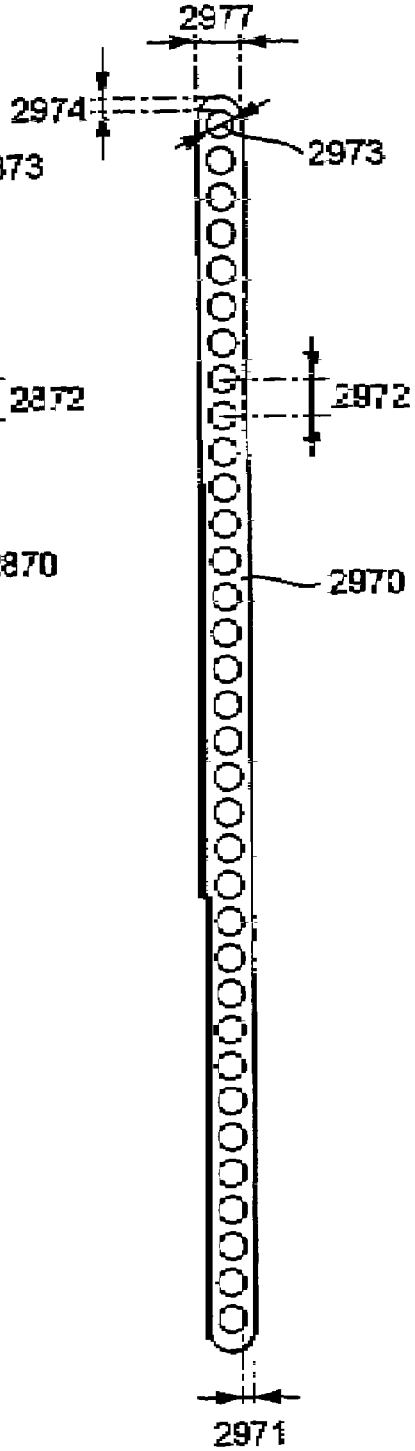

According to a particularly preferred embodiment, FIGS. 32, 33 and 34 show further configurations 2770, 2870 and 2970, respectively, of a heat-exchange tube, in particular of a flat tube, having the flow routes 2773, 2873 and 2973, respectively, which have a hydraulic diameter of between 0.1 and 3 mm, preferably between 0.5 and 2 mm and particularly preferably between 1.0 and 1.6 mm. The bursting-pressure range of a tube is in particular >300 bar in accordance with the present invention, and consequently the wall has to have a minimum thickness which is dependent on the material. According to a particularly preferred embodiment, the thickness of the wall between the outer boundary of the flat tube and the inner boundaries of the flow routes is between 0.1 and 0.3 mm, particularly preferably between 0.15 and 0.25 mm, and particularly preferably between 1.17 and 2.2 mm.

FIG. 32 shows an alternative embodiment of a tube 2770 with 25 flow routes 2773, the mean hydraulic diameter of which is approx. 1.0 mm. The tube width 2775 is approx. 1.8 mm and the wall thickness 2771 is approx. 0.3 mm. The distance between the flow routes 2772 is approx. 1.6 mm. The distance 2774 between the flow route 2773 and the lateral outer wall 2770 is approx. 0.6 mm.

The tube 2870 in FIG. 33 has 28 flow routes, the hydraulic diameter of which is approx. 1.4 mm. The tube width 2876 is approx. 2.2 mm, and the wall thickness 2871 is approx. 0.3 mm. The distance between the flow routes 2872 is approx. 1.9 mm. The distance 2874 between the flow route 2873 and the lateral outer wall 2870 is approx. 0.6 mm.

Figure 1:
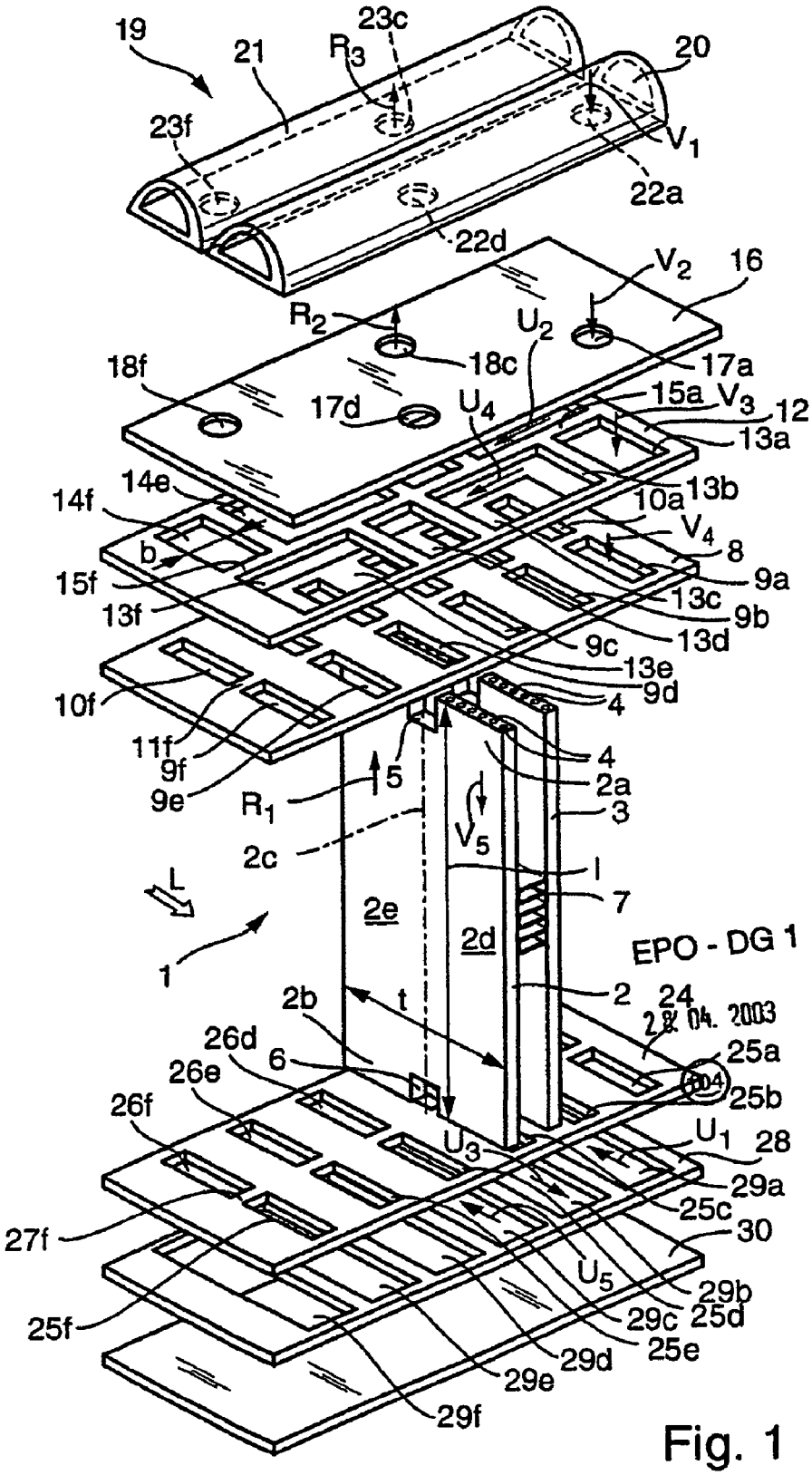
Figure 2:
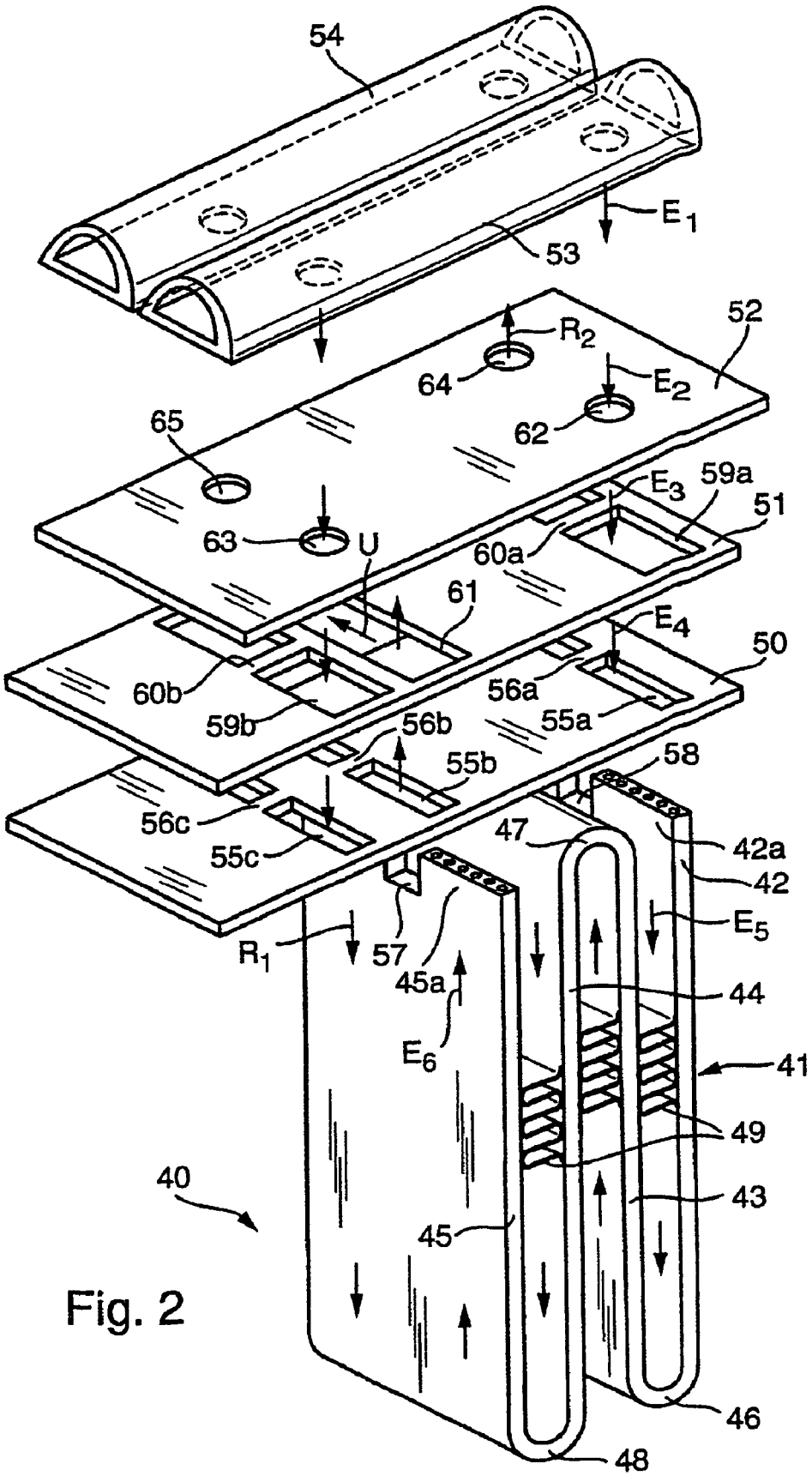
Figure 3:
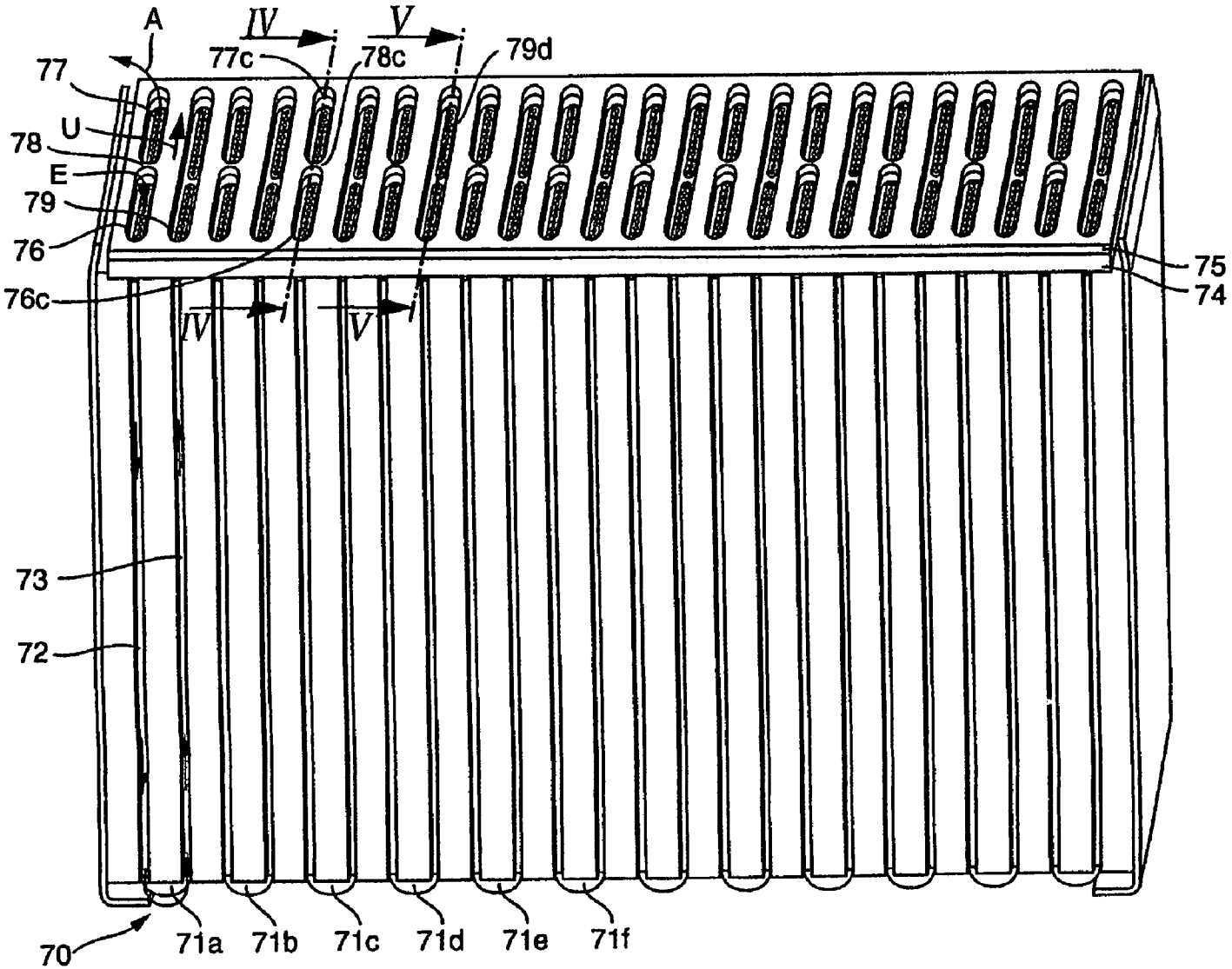
Figure 4:
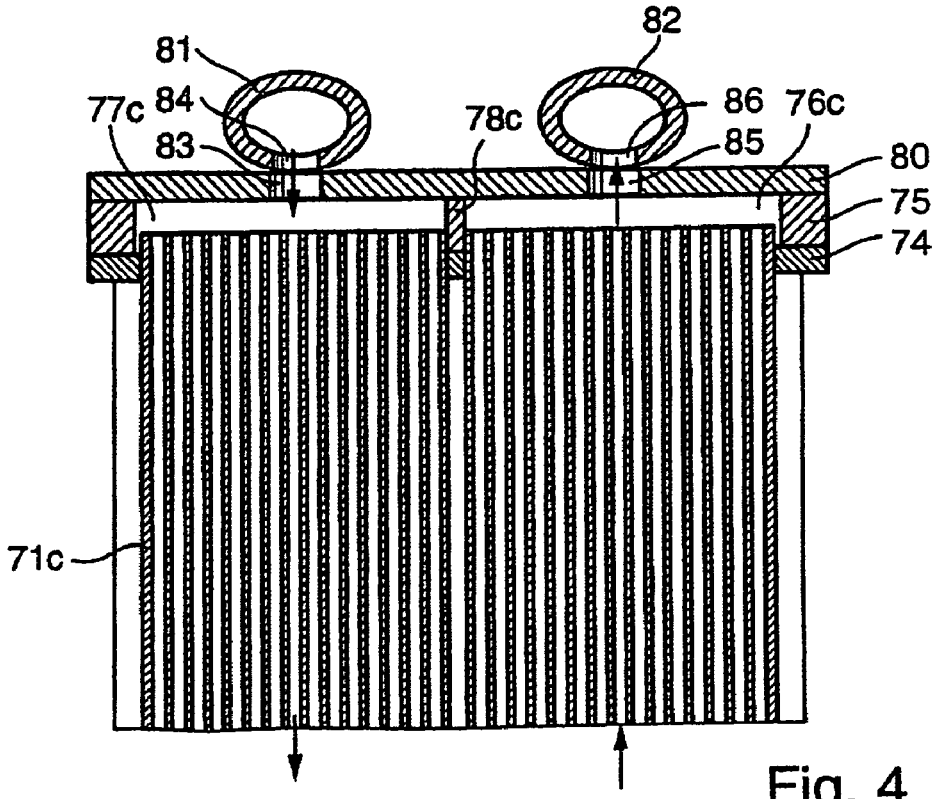
Figure 5:
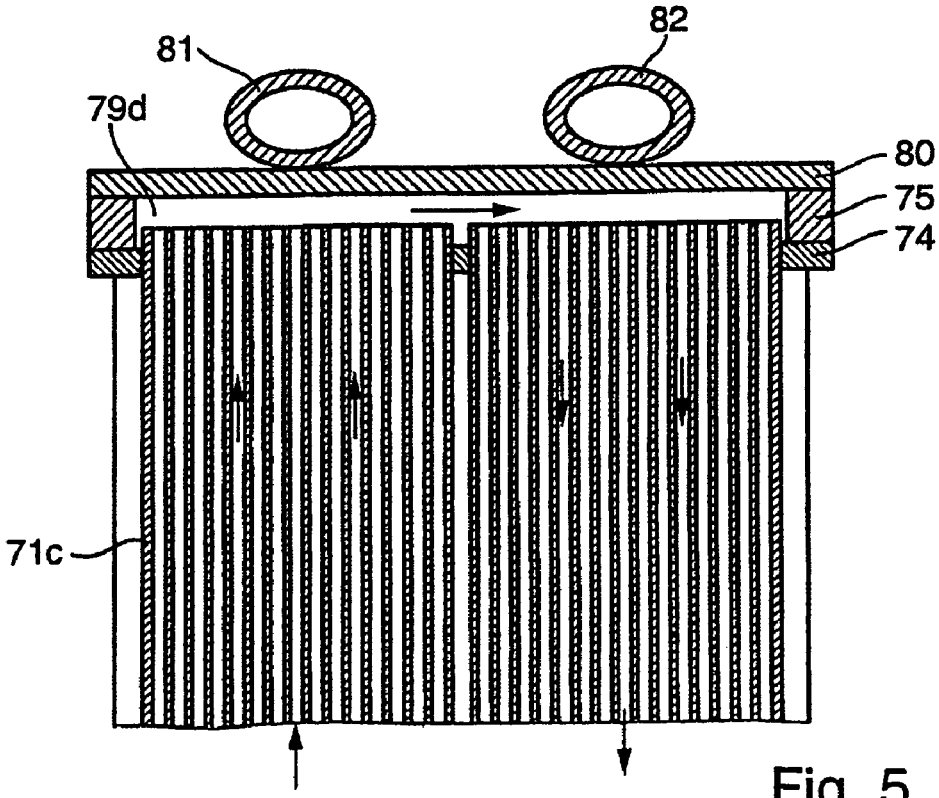
Figure 6:
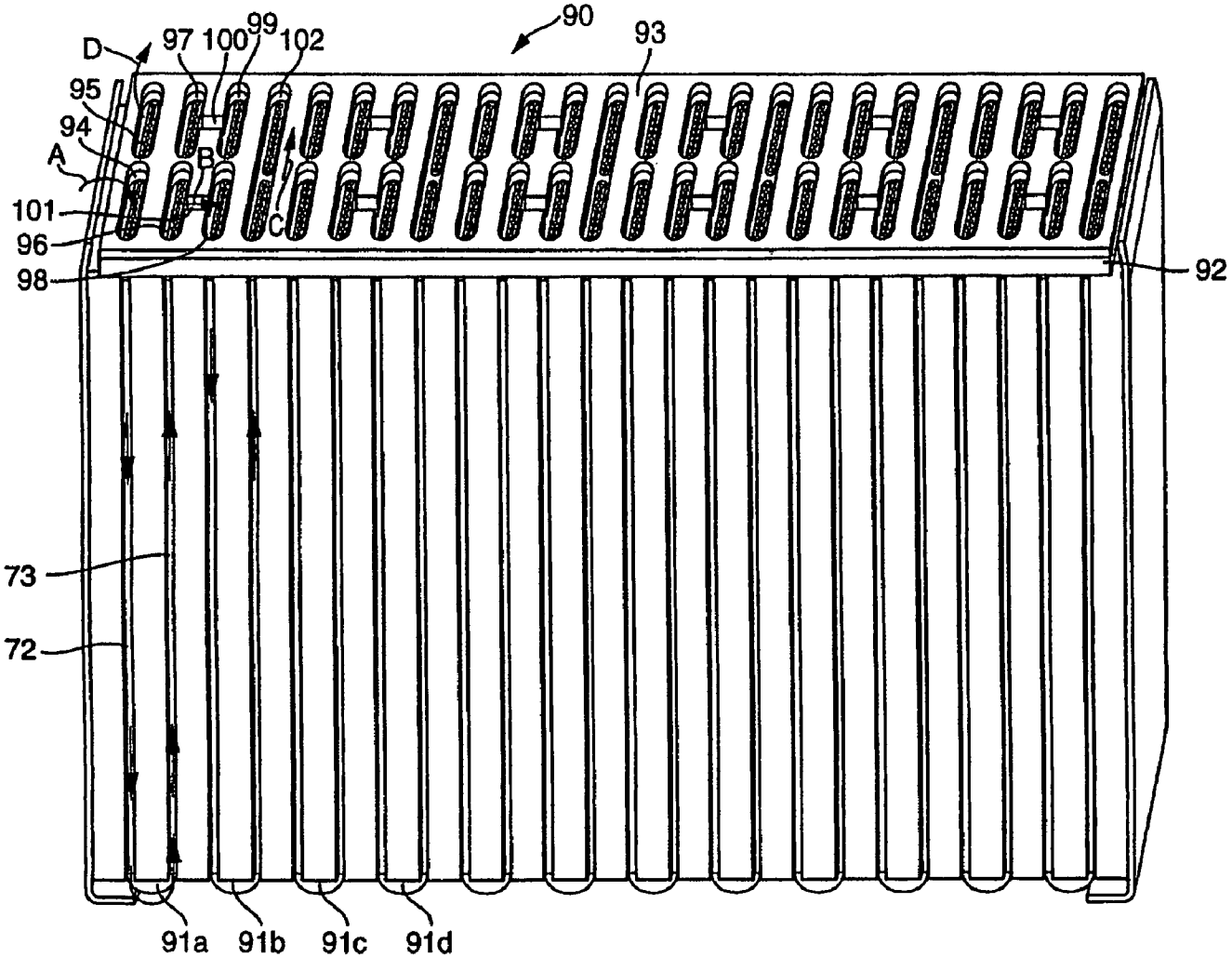
Figure 7:
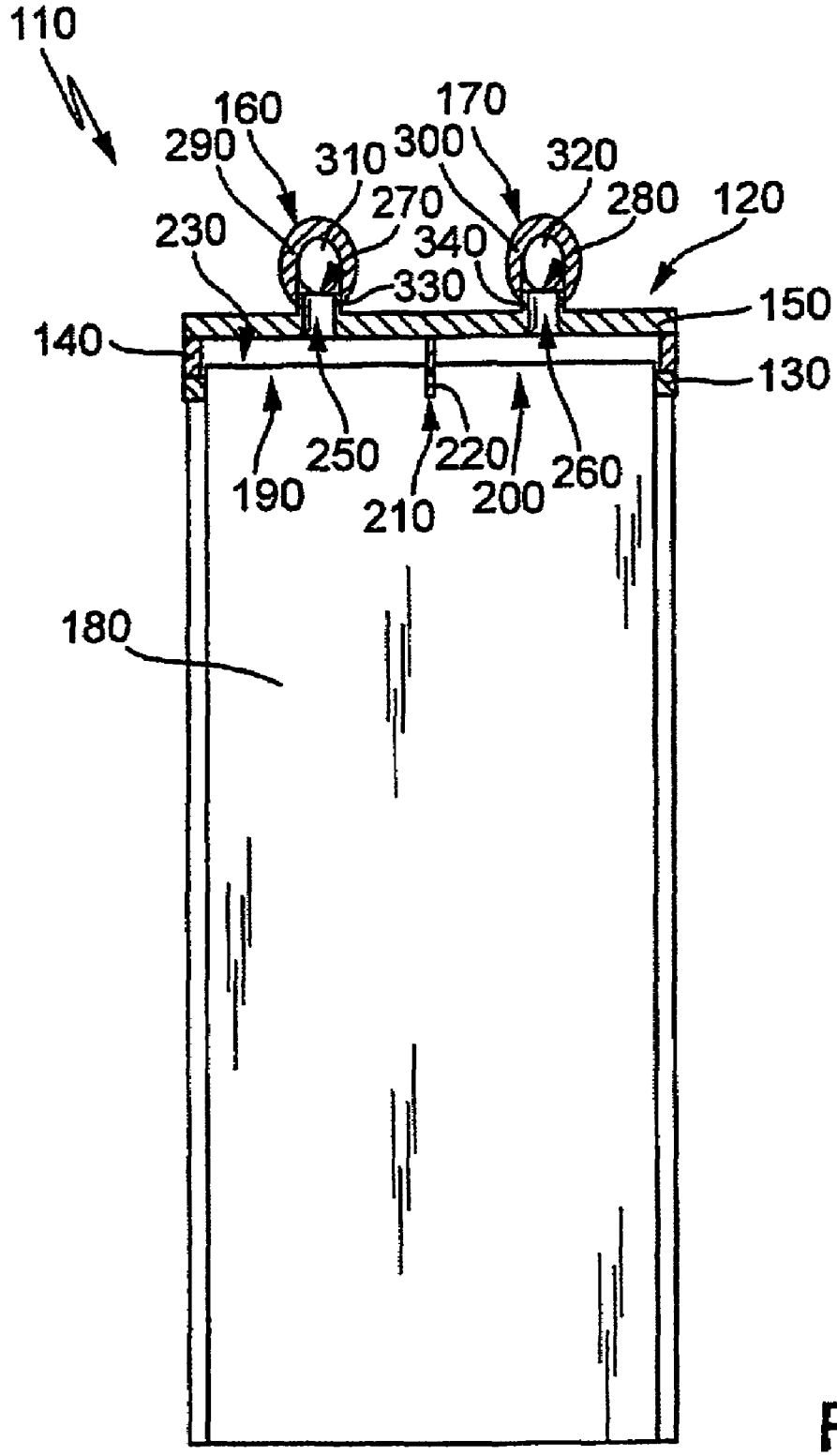
Figure 8:
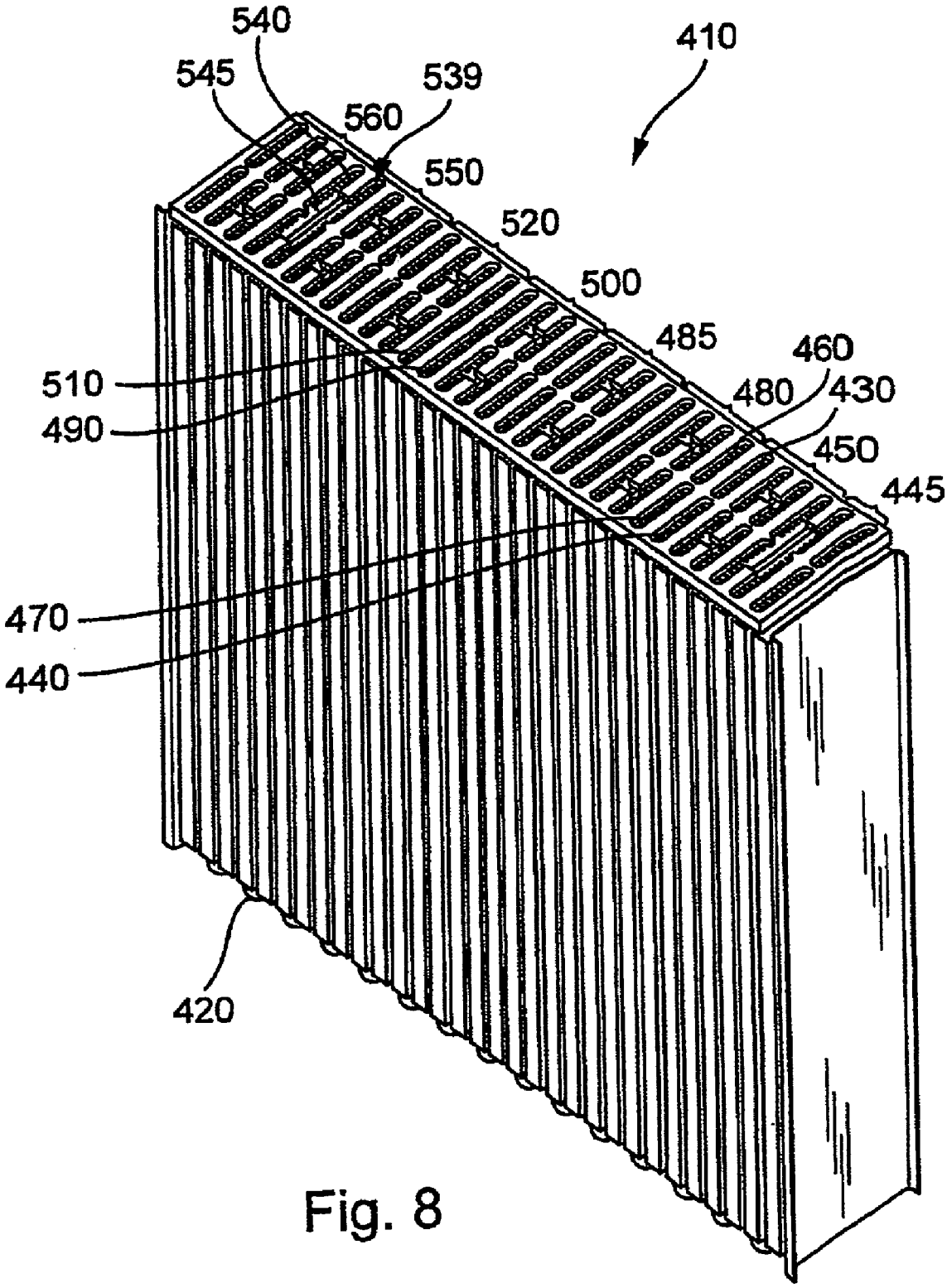
Figure 9:
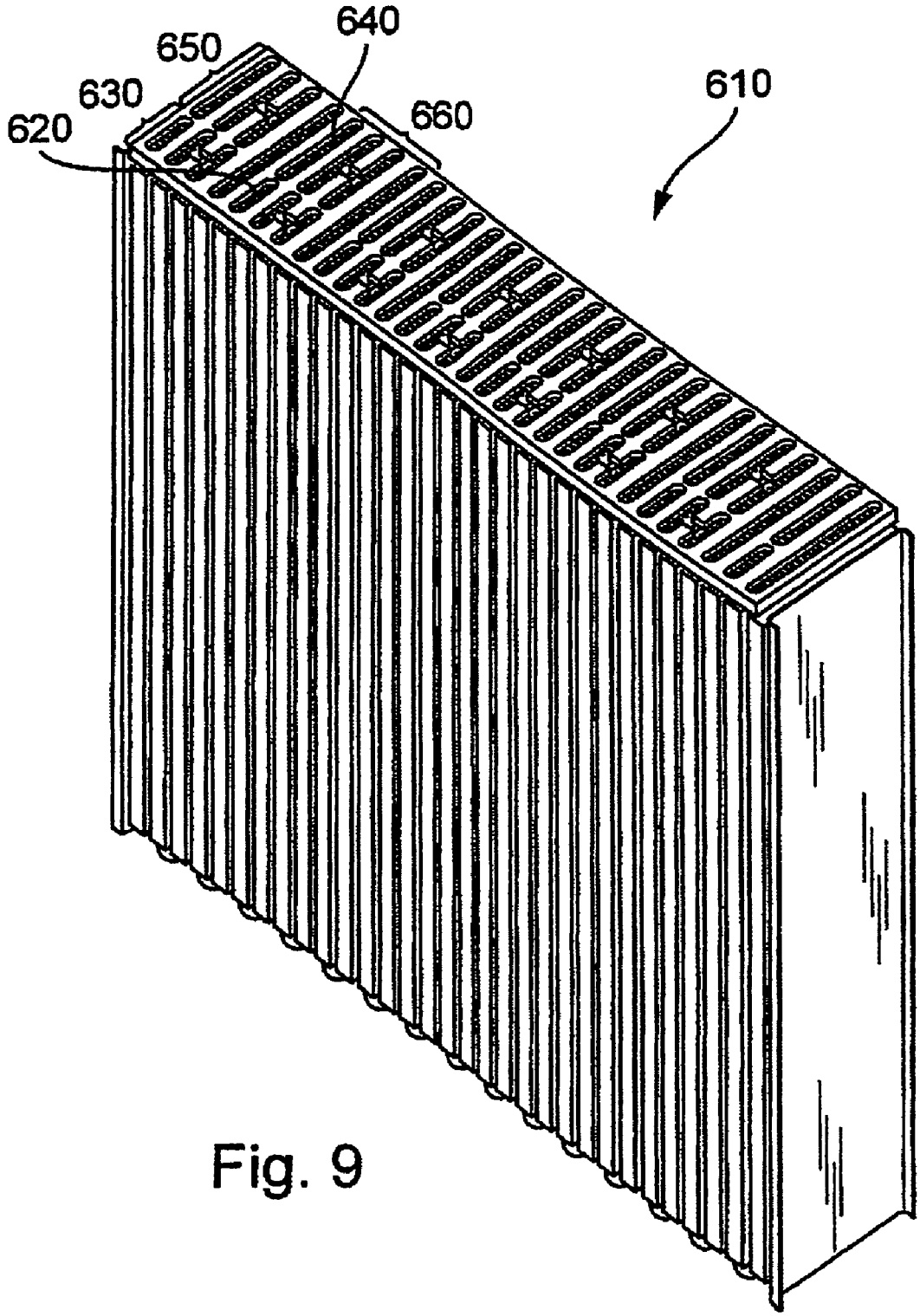
Figure 10:
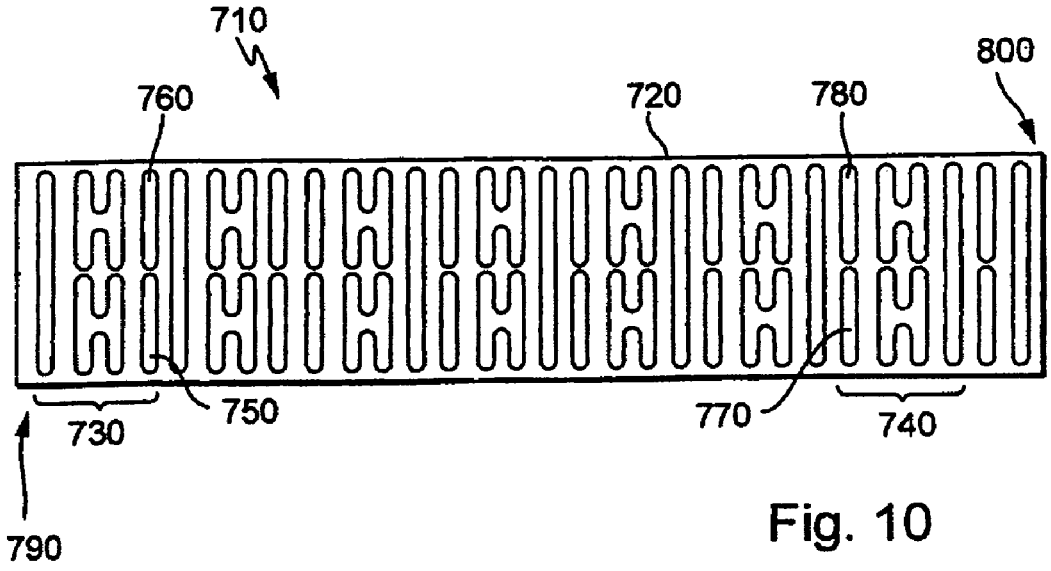
Figure 11:
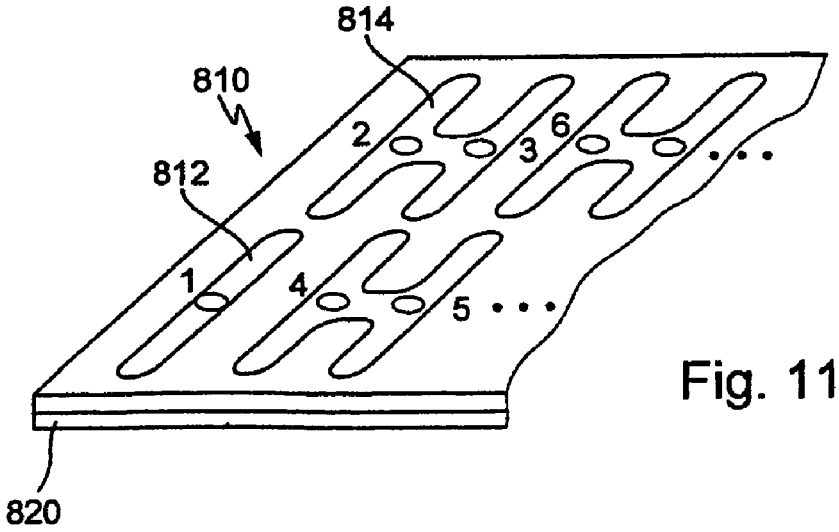
Figure 12:
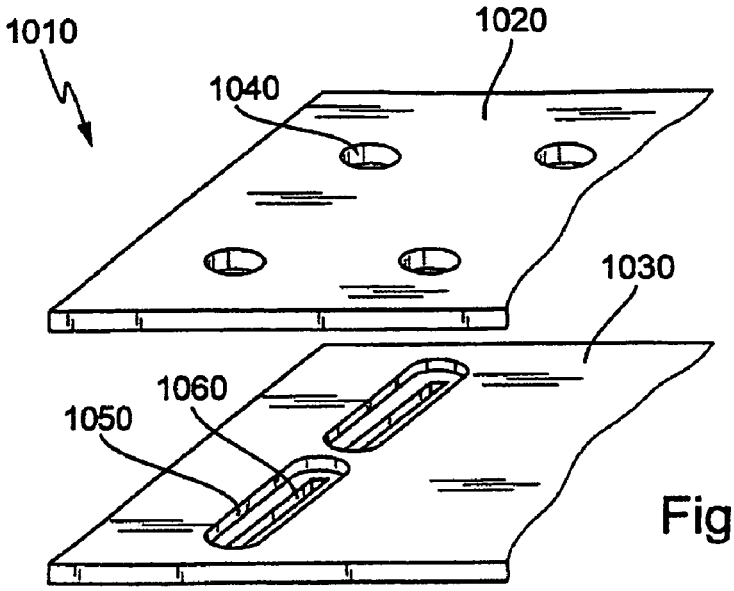
FIG. 12 shows a tube plate 1010 with a cover plate 1020 and a plate 1030 formed by integral configuration of a diverter plate with a base plate. The cover plate 1020 has cutouts 1040 for connection to two collection chambers, while through-passages 1050 of the diverter plate and, beneath them, narrower tube-receiving parts 1060 in the base plate can be seen in the plate 1030.
Figure 13:
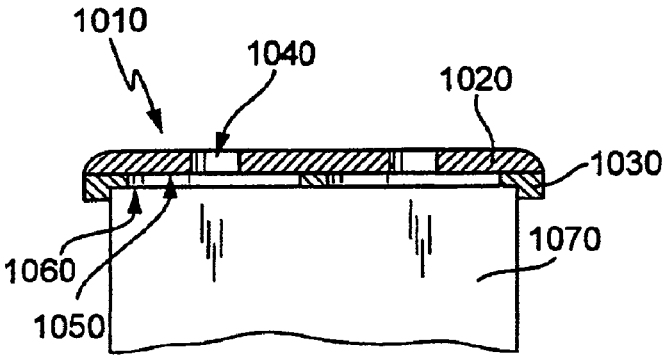
FIG. 13 and FIG. 14 show the tube plate from FIG. 12 in a cross section and a longitudinal section, respectively, in each case in the assembled state with a tube 1070.
Figure 14:
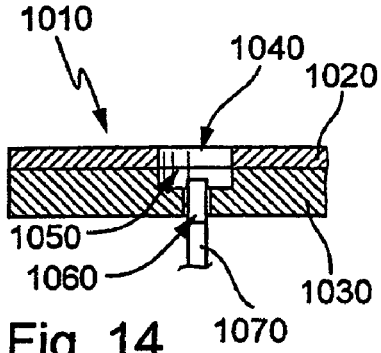
Figure 15:
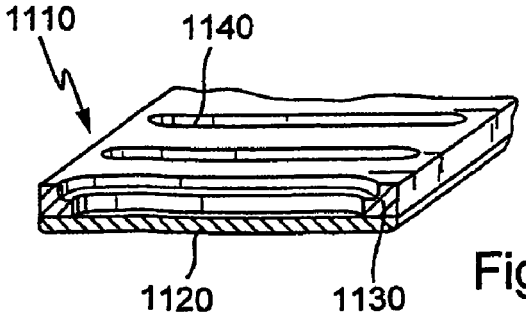
FIG. 15 shows a similar tube plate 1110, the cover plate 1120 of which does not have any cutouts. Diverter passages 1140 for diversion over the depth are arranged in the plate 1130 comprising the diverter plate and the base plate.

FIG. 9 illustrates a flat tube 2970 with 35 flow routes, the mean diameter of which is between 1.0 mm. The tube width 2977 is approx. 1.8 mm and the wall thickness 2971 is approx. 0.3 mm. The distance between the flow routes 2972 is approx. 1.6 mm. The distance 2974 between the flow route 2973 and the lateral outer wall 2970 is approx. 0.6 mm.

Figure 35:
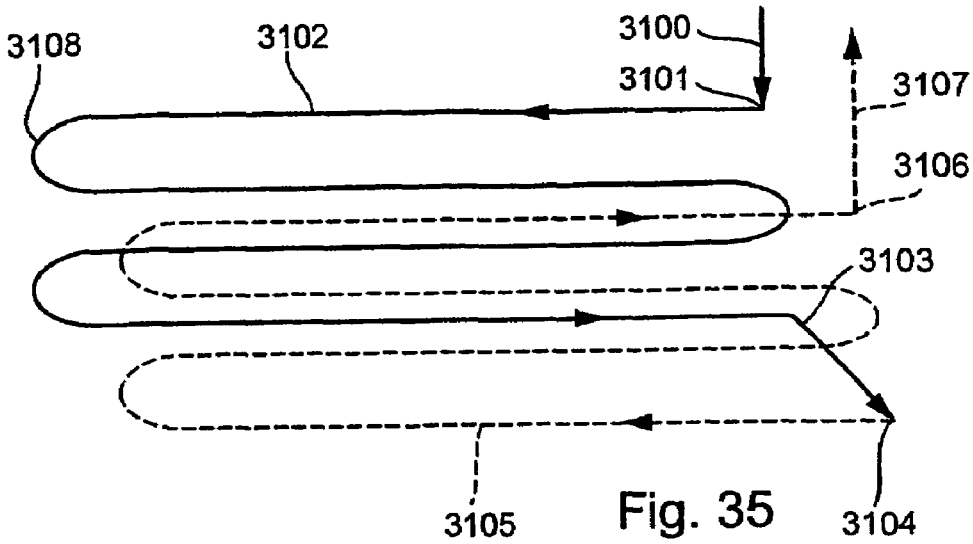

FIG. 35 shows a diagrammatic profile of the refrigerant through a flow path 3102 of a heat exchanger; reference numeral 3100 diagrammatically depicts the refrigerant inlet. The refrigerant is fed to the flow path 3102 via the header tube, the position of which is characterized by reference numeral 3101, and in region 3108 experiences its first change in direction, which is caused by a diversion perpendicular to a main direction of flow of a second medium, for example in a tube bend. The coolant flowing within the tubes opens out in the region 3103 through a further diversion, in this case in a main direction of flow of the second medium, for example diverted through a diverter passage in a transverse distributor into the rear part of the flow path, i.e. into the rear flow-path sections 3105.

In accordance with 3102, thermal energy is also withdrawn from the second medium, such as for example the air, in section 3105 and transferred to the refrigerant. This refrigerant is combined as a liquid-gas mixture in the outlet section of the header tube 3106 and returned via the refrigerant discharge line 3107 into the adjoining pipeline system, for example of an air-conditioning system.

Figure 36:
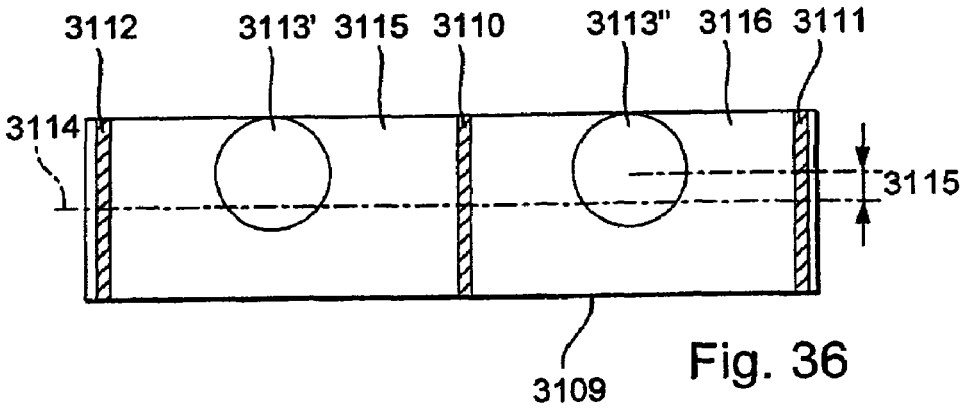

FIG. 16 diagrammatically depicts a header tube in side view, illustrating not only the separating elements 3110, 3111 and 3112 but also the leadthroughs for the refrigerant inlet and outlet 3113' and 3113", respectively. According to a particularly preferred embodiment, the apertures 3113' and 3113" are offset from the center axis of the header tube 3114 by a distance 3115, which distance, according to the present invention, is between 0 and 20 mm, preferably between 0 and 10 mm and particularly preferably between 0 and 5 mm. The separating element 3110 divides the header tube into two sections 3115 and 3116, which according to the arrangement of the header tube represent either the refrigerant inlet section or the refrigerant outlet section. The separating elements 3111 and 3112 close off the header tube with respect to the surrounding environment, it being possible for these separating elements to be arranged at a distance from an outer edge of the header tube or to be arranged so as to end flush with the outer edge of the header tube. According to a further preferred embodiment, the section of the header tube may also be closed off by a soldering or welding spot. The leadthroughs for one or more heat-exchange tubes are not shown in FIG. 36.

Figure 37:
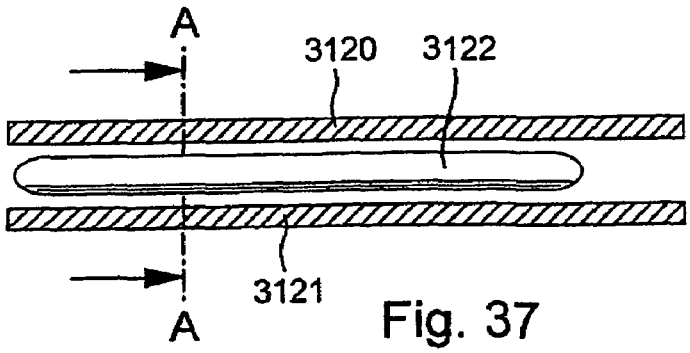

FIG. 37 shows an alternative embodiment for a leadthrough for a tube in a header tube. This figure reveals not just the two limbs 3120 and 3121 of the header tube but also the leadthrough 3122, which according to a preferred embodiment is configured in such a way that it corresponds to the outer shape of the flat tube which is to be introduced. According to a further embodiment, the aperture may also be configured in such a way that, for example, two or more flat tubes can be received in the header tube.

Figure 38:
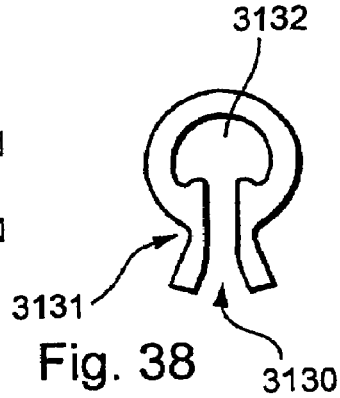

FIG. 38 shows a cross section through a header tube in accordance with FIG. 37 on line A-A. The illustration shows the Ω-shaped basic structure of the header tube, which represents a particularly preferred embodiment in accordance with the present invention. The tube is fitted into the leadthrough 3130 in the header tube and extends as far as into the interior 3132 of the header tube. This embodiment also has the option of connecting the tube to the header tube by clamping prior to optional cohesive bonding of the individual components during production of the heat exchanger. In this case, in particular the geometric shape of a header tube in accordance with the exemplary embodiment from FIG. 38 is used in such a way that the narrowed region 3131 is clamped to the tube after the tube has been introduced.

According to a further particularly preferred embodiment, it is also possible for two or more tubes to open out in a header tube of the configuration shown in FIG. 38. This provides a particularly preferred arrangement of the tubes, as illustrated by reference numeral 2654 in FIG. 30.

Figure 39:
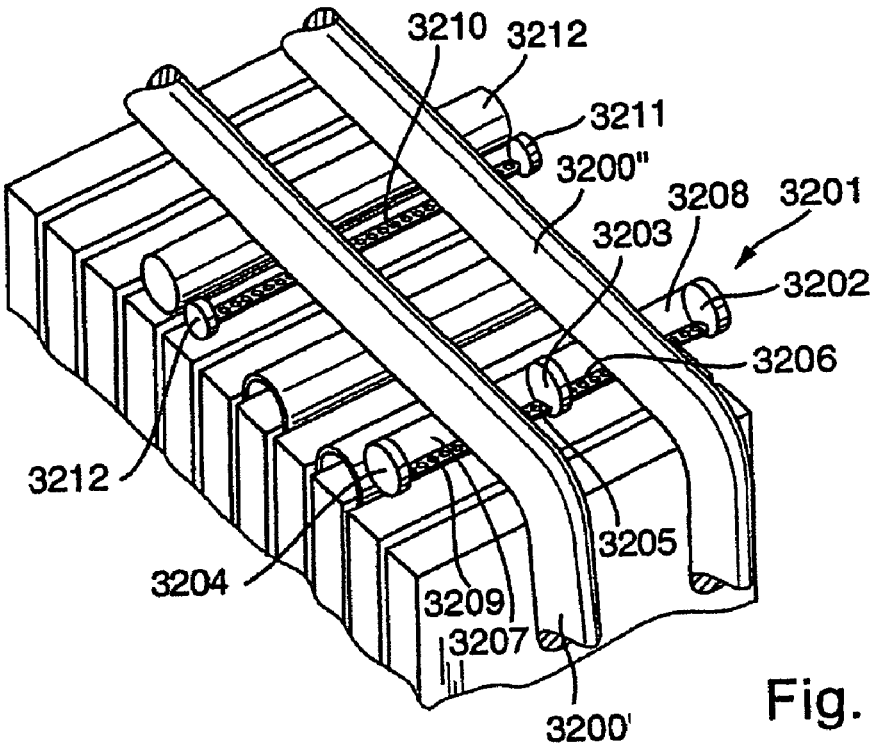

FIG. 39 shows a perspective view of a heat exchanger, illustrating not just the refrigerant inlet or refrigerant outlet 3200", but also a header tube 3201 with the separating elements 3202, 3203 and 3204. In accordance with the exemplary embodiment illustrated, the separating element 3203 extends within the lumen of the header tube 3201, in such a manner that it engages in a recess in the tube 3205. Furthermore, the header tube 3201 is divided into a refrigerant inlet section 3207 and a refrigerant outlet 3208 by the separating element 3203.

The first medium flows from the inlet 3207 via the heat-exchange passages 3209 of the tubes into the transverse distributor 3212, which is likewise closed off from the surrounding environment by two separating elements 3211 and 3212. In the transverse distributor 3212, the first medium is then diverted onto the returning heat-exchange passages 3210, which then open out via the header tube 3201 into the outlet section 3208, from which the first medium is discharged via the outlet 3200".

Figure 40:
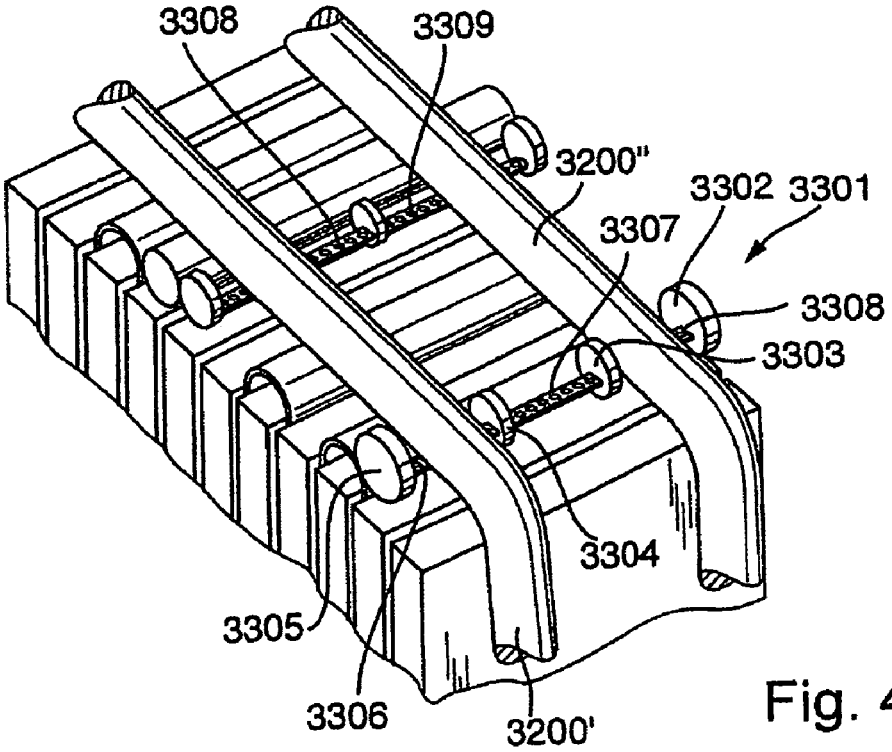

FIG. 40 shows an alternative embodiment of a heat exchanger, in which the inlet 3200' and the outlet 3200" are connected to the header tube 3301. According to this particularly preferred embodiment, the header tube 3301 has four separating elements 3302, 3303, 3304 and 3305, which divide the header tube 3301 into three sections 3306, 3307 and 3308. The first medium is passed via the inlet 3201 into the first section of the header tube 3306 and is then passed via a flat tube into the transverse distributor section 308. From there, the first medium is passed back to the header-tube section 307, and then back to the transverse-distributor section 309, in order then to be fed back via the flat tube into the third section 3308 of the header tube. Following the section 3308, the first medium is passed into the outlet 3200" and returned into the tube system, for example of an air-conditioning installation.

Figure 41:
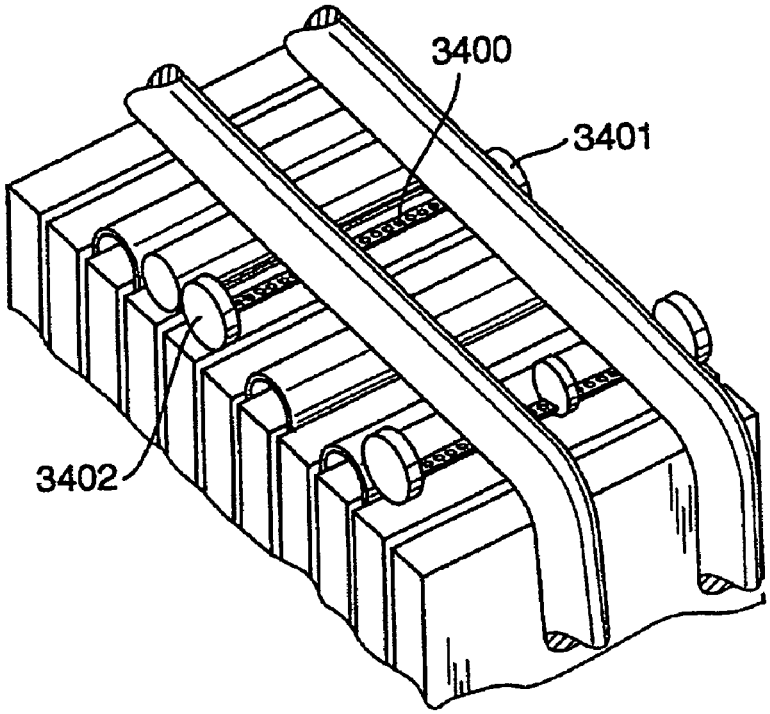

FIG. 41 shows an alternative embodiment of a heat exchanger, in which in particular the transverse distributor 4300 is closed off by two separating elements 3401 and 3402 bearing against the outside.

Figure 42:
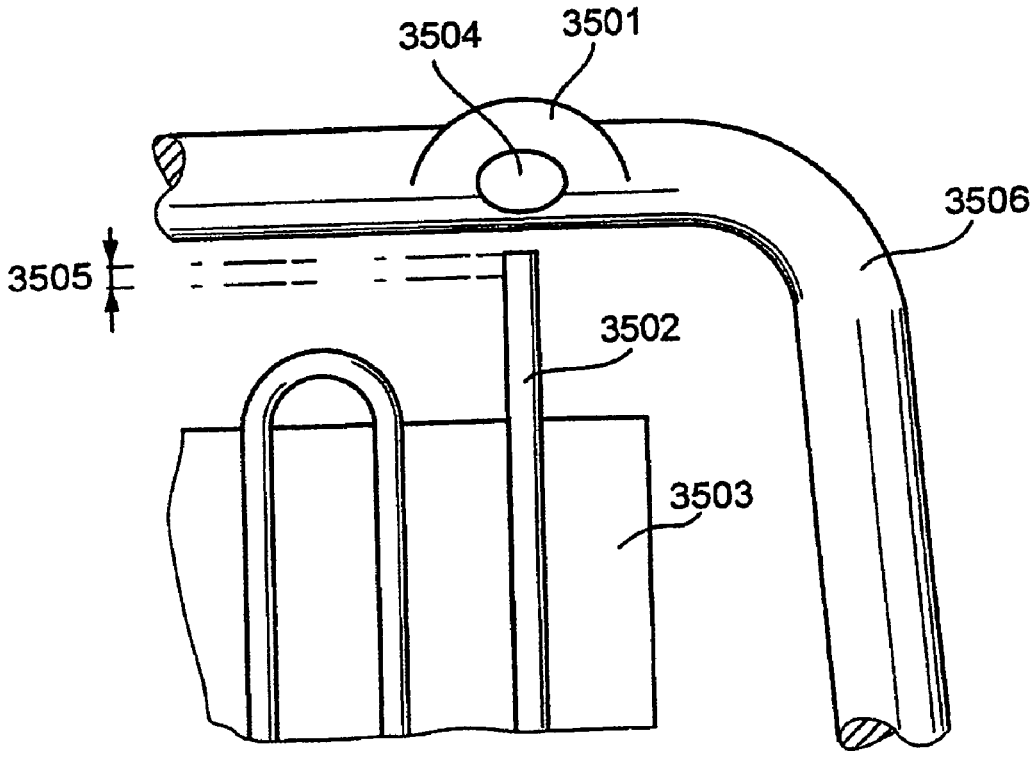

FIG. 42 shows a detailed illustration of the heat exchanger from FIG. 41, illustrating not just the header tube 3501 but also the tube 3502 and the diagrammatically illustrated cooling fins 3503. The illustration shows in particular, in the lumen of the header tube 3501, the depth of penetration 3505 of the tube 3502 into the interior of the header tube and the opening or openings 3504 arranged in the inlet tube, through which the header tube is fluid-connected to the inlet or outlet.

Figure 43:
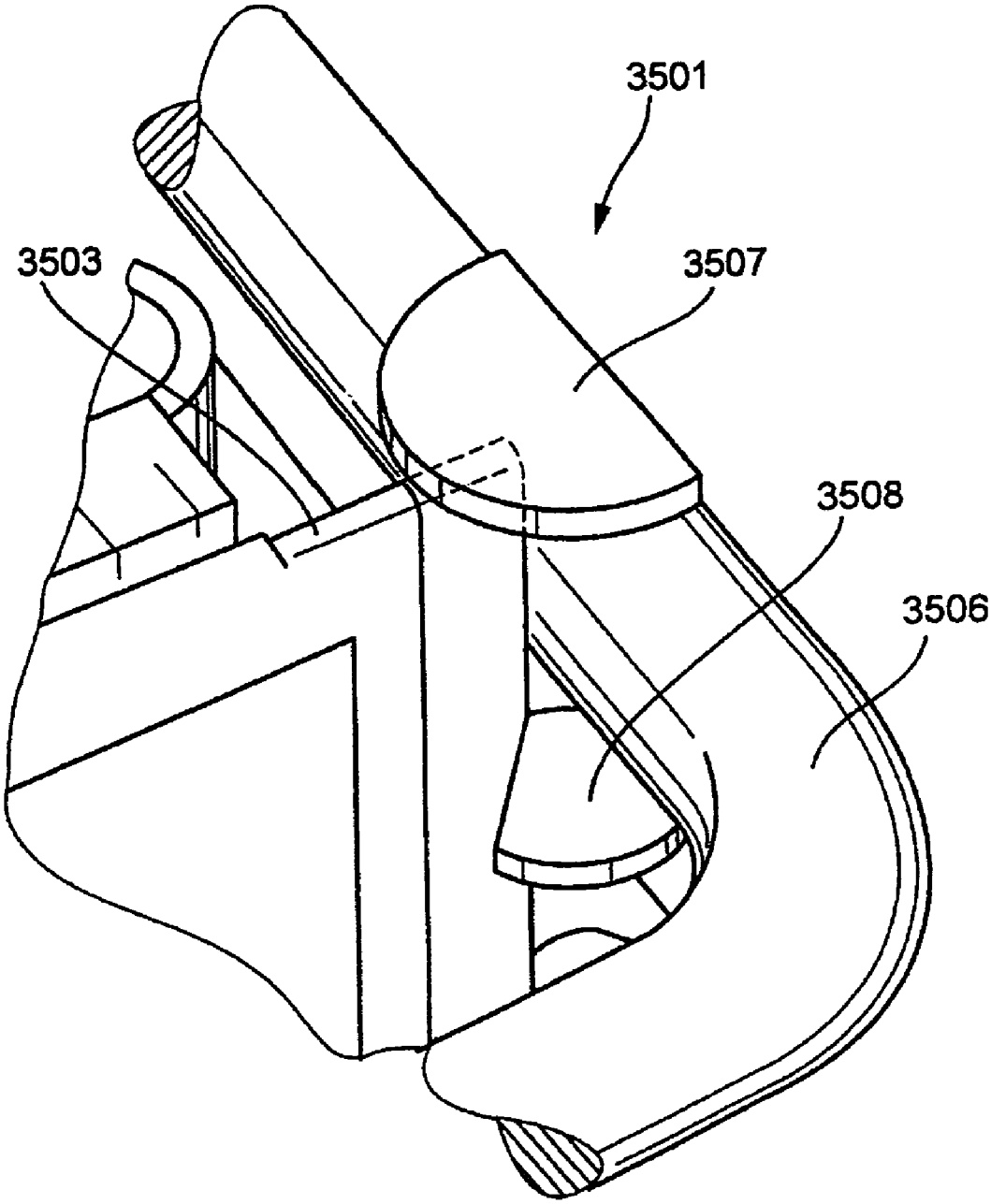

FIG. 43 shows an excerpt from the heat exchanger in the form of a perspective illustration, revealing not only the header tube 3501 but also the separating element 3507, the tube 3503, the inlet 3506 and a further separating element 3508, which divides the header tube 3501 into an inlet section and an outlet section.

Figure 44:
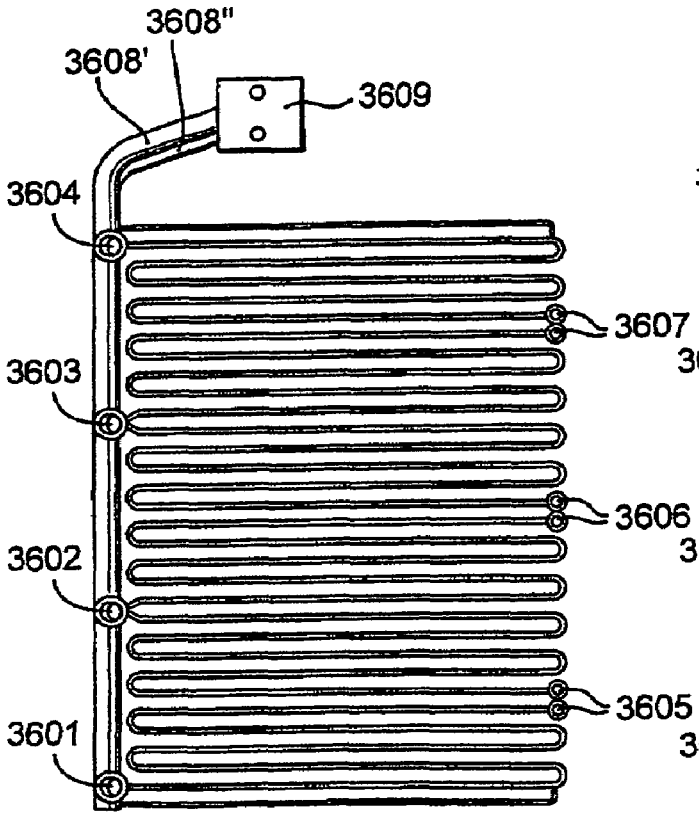

FIG. 44 shows an alternative embodiment of a heat exchanger in accordance with the present invention, the header tubes 3601, 3602, 3603 and 3604 or which are arranged on one side of the heat exchanger and opposite the transverse-distribution tubes 3605, 3606 and 3607. Furthermore, the inlet 3608" and the outlet 3608' open out in a coupling device 3609 which connects the two pipelines to the pipeline system, for example of an air-conditioning unit.

Figure 45:
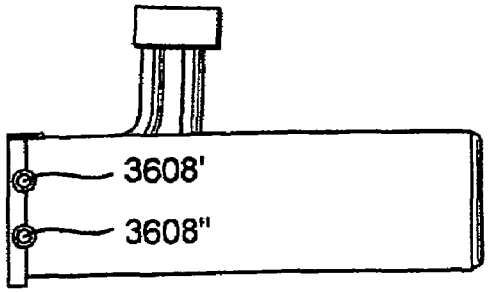

FIG. 45 shows a side view of the heat exchanger in accordance with FIG. 17. This figure reveals in particular the arrangement of the inlet 3608' and of the outlet 3608', the center axes of which are respectively offset by a different amount from the center axis of the header tubes. Furthermore, the two tubes have different cross sections, in order to take account of the different density of the first medium before and after it has flowed through the heat exchanger.

Figure 46:
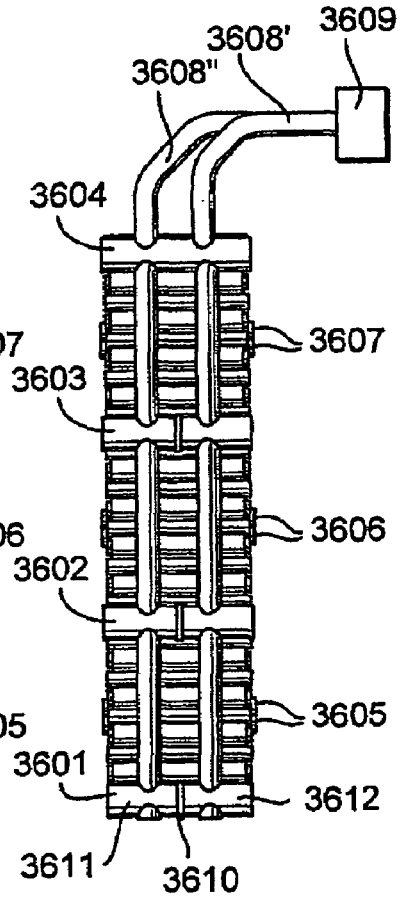

FIG. 46 shows a plan view of the heat exchanger shown in FIG. 44. In addition to the header tubes 3601, 3602, 3603 and 3604, the figure also illustrates the inlet 3608" and the outlet 3608", the connecting device 3609 and the transverse-distribution tubes 3605, 3606 and 3607. Furthermore, the header tubes are divided into an outlet section 3611 and an inlet section 3612 by the separating elements 3610.

Figure 47:
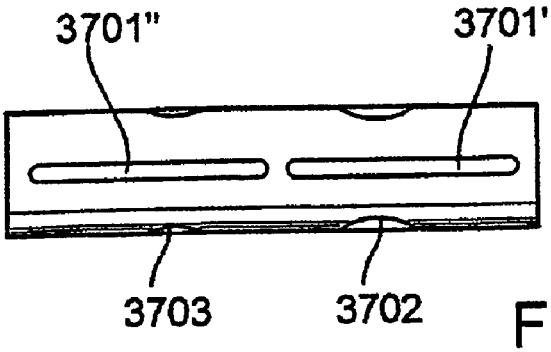

FIG. 47 shows a header tube for a heat exchanger in accordance with the present invention, which in addition to two leadthroughs 3701' and 3701" for one or two flat tubes, also includes the two apertures 3702 and 3703 for the inlet and outlet, respectively. In accordance with a particularly preferred embodiment, the inlet has a smaller diameter than the outlet, since the use of the heat exchanger as an evaporator causes the specific density of the refrigerant to decrease through evaporation.

Figure 48:
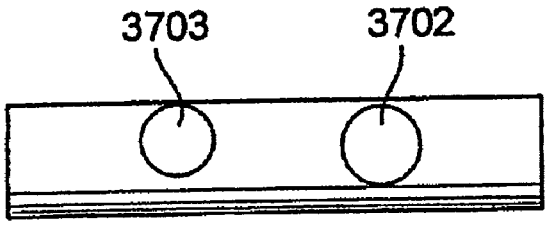
Figure 49:
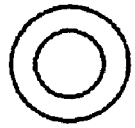

FIG. 48 shows a side view of the header tube from FIG. 20, providing a particularly good view of the apertures 3702 and 3703. FIG. 49 shows an end side of the header tube in accordance with FIG. 20.

Figure 50:
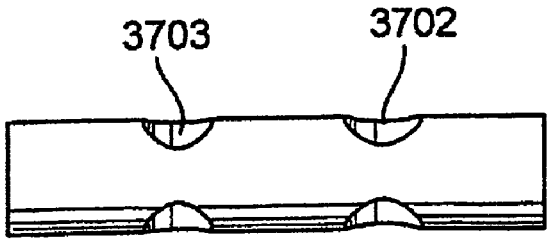

FIG. 50 shows a plan view of the header tube from FIG. 47, revealing in particular the two apertures 3702 and 3703 for the refrigerant inlet and refrigerant outlet, respectively.

Figure 51:
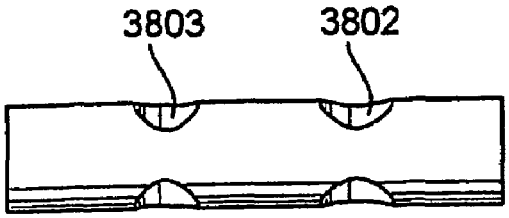

FIG. 51 shows a further embodiment of a header tube in accordance with the present invention. In addition to the different cross sections of flow for the inlet 3803 and outlet 3802, this embodiment has four leadthroughs 3805, 3806, 3807 and 3808 for two or four flat tubes which open out in the lumen, i.e. in the interior of the header tube.

Figure 52:
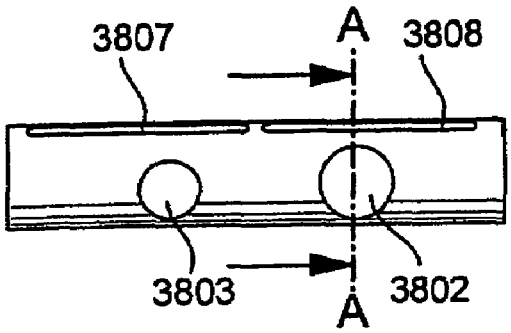

FIG. 52 shows a side view of a header tube of this type, the leadthroughs of which for the flat tubes are represented by reference numerals 3807 and 3808.

Figure 53:
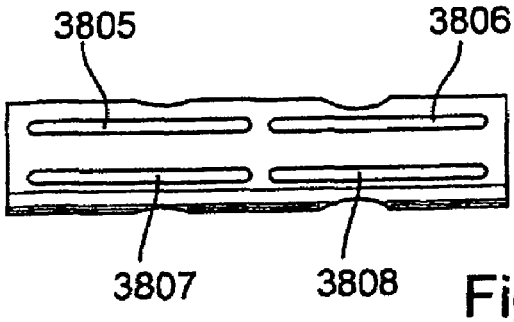
Figure 55:
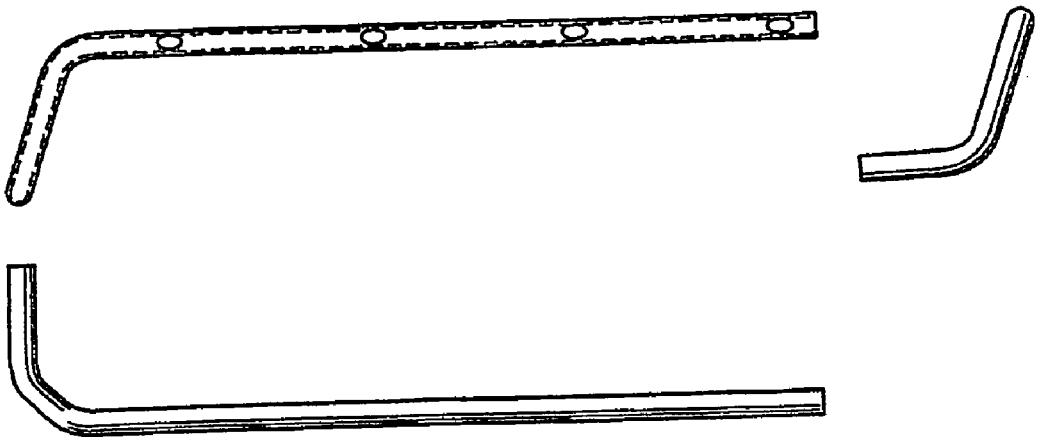
Figure 56:
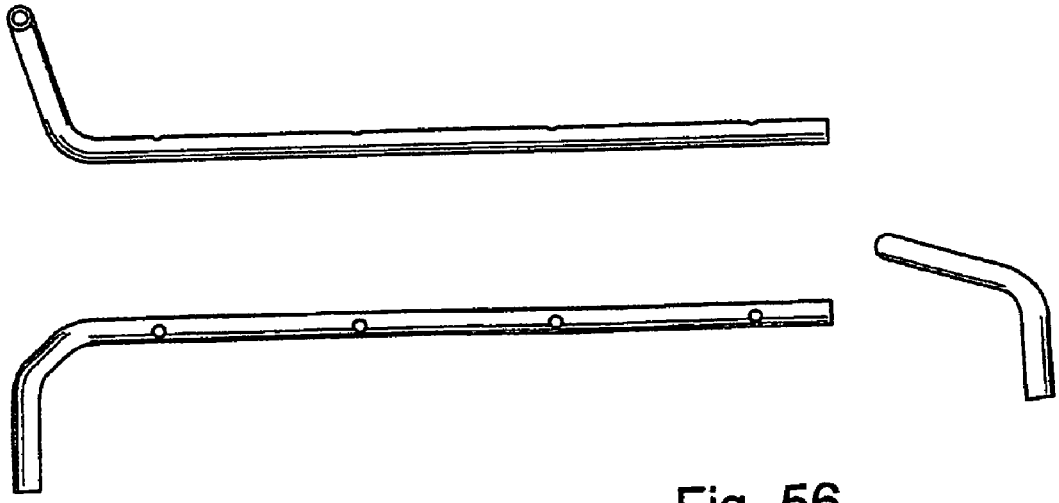
Figure 57:
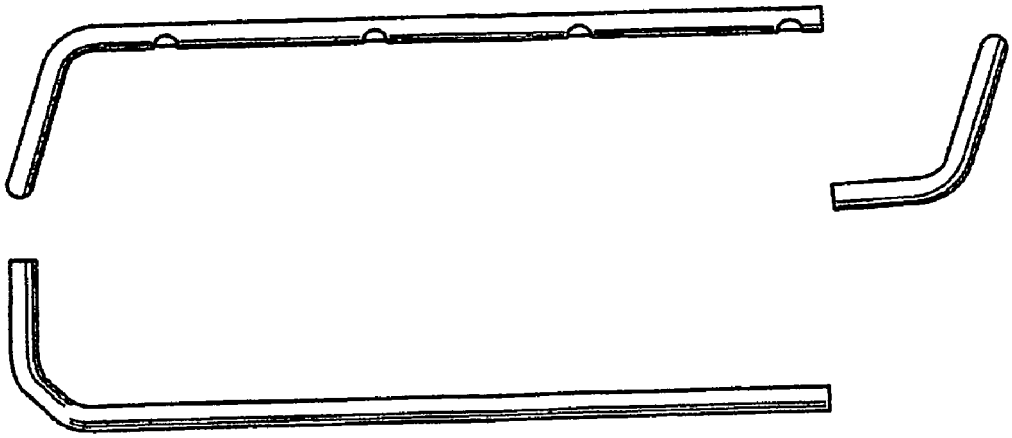
Figure 58:
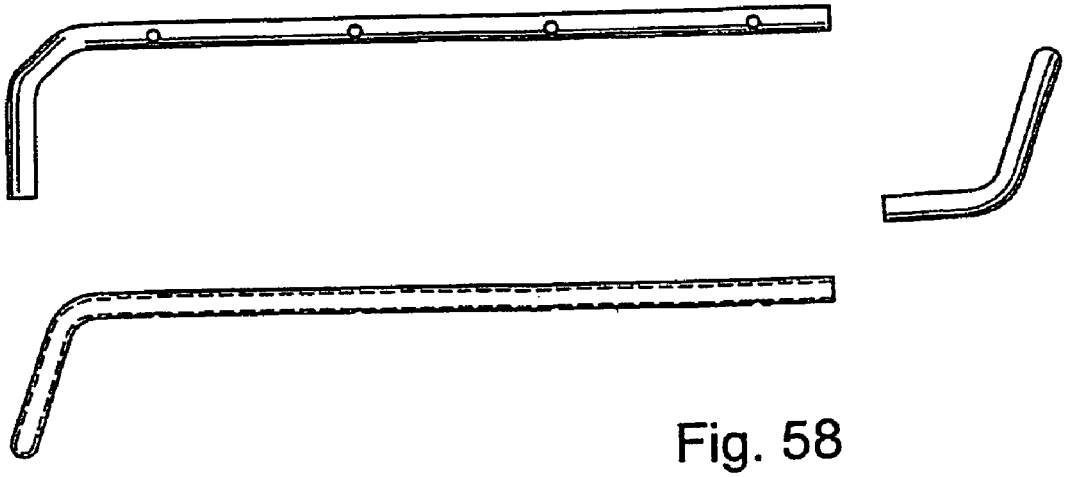

FIG. 53 shows a view of a header tube in accordance with the present invention from below, this tube having four leadthroughs 3805, 3806, 3807 and 3808 for the flat tubes.

Figure 54:
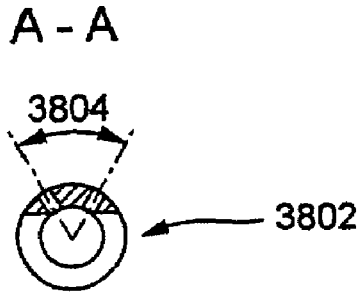

FIG. 54, representing a cross-sectional view through a header tube in accordance with FIG. 51, illustrates the angle 3804 which determines the way in which the flat tubes open out into the interior of the header tube.

FIGS. 55, 56, 57, 58 show various embodiments of an inlet and an outlet, in particular of a refrigerant inlet and outlet. In addition to the arrangement of the outlet openings, the exemplary embodiments also differ with regard to the configuration of the apertures for passage into the header tubes and the hydraulic diameter thereof.

The present invention has been described in part on the basis of the example of an evaporator. However, it should be noted that the heat exchanger according to the invention is also suitable for other uses.

The invention claimed is:

1. A heat exchanger, comprising:

tubes which, along a plurality of flow paths which are hydraulically in parallel, have a first medium flowing through them and a second medium flowing around them, wherein two sections of a flow path, through which medium can flow in opposite directions, are arranged next to one another in the main direction of flow of the second medium, wherein the heat exchanger comprises a distribution and/or collection device with at least one diverter passage which connects the heat-exchange passages of two flow-path sections which are arranged in a single tube and through which the first medium can flow in succession to one another, wherein the plurality of flow paths comprise at least a first flow path and a second flow path, wherein the first flow path and the second flow path each comprise a front section and a back section arranged such that, in the main direction of flow, the second medium contacts the front section and the back section sequentially, and wherein the first section and the second section are each connected via a linking section.

2. The heat exchanger as claimed in claim 1, wherein the parallel flow paths are arranged next to one another, in particular without an overlap, in the main direction of flow of the second medium.

3. The heat exchanger as claimed in claim 1, wherein the parallel flow paths are each limited to a continuous subregion of an end face of the heat exchanger which the flow of the second medium can reach.

4. The heat exchanger as claimed in claim 1, wherein the at least one distribution and/or collection device which is in communication with the tubes, with all the distribution and/or collection devices is arranged on one side of the heat exchanger.

5. The heat exchanger as claimed in claim 1, wherein the at least one distribution and/or collection device comprises a tube plate which comprises plates bearing against one another, it being possible for ends of the tubes to be connected to a base plate of the tube plate, and wherein at least one pass-through and/or diverter passage is formed by a cutout in a diverter plate of the tube plate and can be closed off in a fluid-tight manner with respect to an environment surrounding the heat exchanger by a cover plate.

6. The heat exchanger as claimed in claim 1, further comprising a distribution and/or collection device which comprises a housing and at least one collection chamber.

7. The heat exchanger as claimed in claim 6, wherein the distribution and/or collection device comprises a tube plate with cutouts, it being possible for tubes to be accommodated in the cutouts.

8. The heat exchanger as claimed in claim 1, wherein the distribution and/or collection device comprises at least one refrigerant inlet and at least one refrigerant outlet, which open out into at least one header tube, the at least one header tube being divided by at least one separating element into at least one inlet section and at least one outlet section, and at least one tube around which the second medium can flow opening out into the at least one header tube.

9. The heat exchanger as claimed in claim 1, wherein two or more flow-path sections are hydraulically connected to one another by a transverse distributor.

10. The heat exchanger as claimed in claim 1, wherein at least one diverter passage connects the heat-exchange passages of two flow-path sections through which the first medium can flow in succession to one another on the basis of predetermined criteria.

11. The heat exchanger as claimed in claim 10, wherein the two flow-path sections which are connected to one another are arranged next to one another in the main direction of flow of the second medium.

12. The heat exchanger as claimed in claim 10, wherein the two flow-path sections which are connected to one another are arranged one behind the other in the main direction of flow of the second medium.

13. The heat exchanger as claimed in claim 10, wherein the two flow-path sections which are connected to one another are arranged in a single tube.

14. The heat exchanger as claimed in claim 1, wherein the number of sections of at least one flow path can be divided by two.

15. The heat exchanger as claimed in claim 1, wherein for each flow path hydraulically the first section is arranged in a tube which, within a row of tubes, is adjoined by tubes on two opposite sides.

16. The heat exchanger as claimed in claim 1, wherein two adjacent flow paths run mirror-symmetrically with respect to one another.

17. The heat exchanger as claimed in claim 1, wherein diverter passages of at least two flow paths communicate with one another.

18. The heat exchanger as claimed in claim 1, wherein a cross section of flow of a flow path changes from one section to a hydraulically succeeding section.

19. The heat exchanger as claimed in claim 18, wherein the cross section of flow of the flow path increases in the direction of a decreasing density of the first medium within the flow path while the heat exchanger is operating.

20. The heat exchanger as claimed in claim 1, wherein the two flow-path sections arranged next to one another are arranged in a tube and are connected to one another via a U-shaped tube bend.

21. The heat exchanger as claimed in claim 20, wherein the tube bend curves in the direction of a shorter side of the tube, which is designed as a flat tube.

22. The heat exchanger as claimed in claim 20, wherein all the tubes have precisely one tube bend.

23. The heat exchanger as claimed in claim 1, wherein at least one tube comprises a plurality of heat-exchange passages, which are assigned to different flow paths and through which medium can flow in opposite directions.

24. The heat exchanger as claimed in claim 1, wherein the tubes are designed as flat tubes.

25. An air-conditioning device, comprising:

at least one air-feed element, at least one heat exchanger and at least one air-guiding passage, wherein at least one heat exchanger is designed as described in claim 1.

26. A motor vehicle comprising a heat exchanger according to claim 1.

27. The heat exchanger as claimed in claim 14, wherein at least one flow path comprises 4 sections.

28. The heat exchanger as claimed in claim 24, wherein the flat tubes comprise corrugated fins arranged between them.

29. A motor vehicle comprising an air-conditioning device according to claim 25.

30. An air-conditioning device according to claim 25, wherein the at least one heat exchanger comprises a refrigerant evaporator.

31. The heat exchanger according to claim 1, wherein the distribution and/or collection device comprises at least 2 inlets or at least 2 outlets.

* * * * *